US011518611B2

(12) United States Patent
Keidel

(10) Patent No.: US 11,518,611 B2
(45) Date of Patent: Dec. 6, 2022

(54) LOCK DEVICE FOR A WASTE RECEIVING DEVICE AND WASTE RECEIVING DEVICE WITH SUCH A LOCK DEVICE

(71) Applicant: Sudhaus GmbH, Iserlohn (DE)

(72) Inventor: Stephan Keidel, Hofheim (DE)

(73) Assignee: SUDHAUS GMBH, Iserlohn (DE)

( * ) Notice: Subject to any disclaimer, the term of this patent is extended or adjusted under 35 U.S.C. 154(b) by 359 days.

(21) Appl. No.: 16/819,752

(22) Filed: Mar. 16, 2020

(65) Prior Publication Data

US 2020/0299993 A1 Sep. 24, 2020

(30) Foreign Application Priority Data

Mar. 19, 2019 (DE) ..... 202019101543.8

(51) Int. Cl.
*B65F 1/16* (2006.01)
*E05B 15/00* (2006.01)
*E05B 65/52* (2006.01)

(52) U.S. Cl.
CPC ..... *B65F 1/1615* (2013.01); *E05B 15/0093* (2013.01); *E05B 65/5292* (2013.01); *B65F 2210/148* (2013.01)

(58) Field of Classification Search
CPC ..... B65F 1/1623; B65F 1/1615; B65F 1/16; B65F 3/24; E05B 15/0093; E05B 65/5292; E05B 65/52; B65D 45/22; B65D 45/20; B65D 45/16; B65D 50/068; B65D 50/067; B65D 55/14; B65D 55/02
USPC ..... 220/210, 326, 324, 315, 908, 264, 263, 220/262, 830, 827, 810; 292/233, 232, 292/231, 230; 70/DIG. 36, DIG. 74
See application file for complete search history.

(56) References Cited

FOREIGN PATENT DOCUMENTS

DE 197 08 193 3/1999
EP 872432 A1 * 10/1998 ..... B65F 1/1615

OTHER PUBLICATIONS

Translation of DE19708193A1. Bartsch et al., Sep. 25, 1997, Paragraphs 6 and 9. (Year: 1997).*

* cited by examiner

*Primary Examiner* — Robert J Hicks
(74) *Attorney, Agent, or Firm* — Nixon & Vanderhye

(57) ABSTRACT

A lock device for a waste receiving device, and a waste receiving device having such a lock device, where the lock device includes an upper lock part to be fastened on a cover of the waste receiving device and a lower lock part to be fastened on a container of the waste receiving device. The upper lock part has an upper lock part housing, a locking mechanism and a first locking element. The lower lock part has a lower lock part housing and a second locking element. The second locking element is pivotable about a swivel axis between a blocking position and a release position, whereby in the blocking position the second locking element cooperates with the first locking element in such a way that the cover is blocked.

16 Claims, 22 Drawing Sheets

LOCK DEVICE FOR A WASTE RECEIVING DEVICE AND WASTE RECEIVING DEVICE WITH SUCH A LOCK DEVICE

BACKGROUND OF THE INVENTION

Field of the Invention

The present invention relates to a waste receiving device, which comprises a container defining on its upper side a container opening enclosed by a container lip and a cover held on the container, said cover being pivotably movable about a cover swivel axis between a closed position closing the container opening and an open position uncovering the container opening, said lock device comprising an upper lock part to be fastened on the cover side with an upper lock part housing, a locking mechanism received in the upper lock part housing and a first locking element projecting downwards from the upper lock part housing and being pivotable about a swivel axis between a locking position and an unlocking position by actuating the locking mechanism; and a lower lock part to be fastened on the container side with a lower lock part housing, a second locking element projecting upwards from the lower lock part housing and being pivotable about a swivel axis between a blocking position and a release position, wherein said second locking element cooperates in its blocking position with the first locking element being in its locking position in such a way that the cover is locked, a weight part operatively connected to the second locking element, said weight part being pivotably received in the lower lock part housing such that it positions the second locking element in its blocking position, when the container is in its upright position, and is automatically transferred into its release position, in which the second locking element is brought out of engagement with the first locking element positioned in its locking position, when the container is tilted forward for emptying, and a first arresting means movably received in the lower lock part housing, said first arresting means being arresting the second locking element in its blocking position, when the container is in its upright position. Further, the present invention relates to a waste receiving device comprising a container having on its upper side a container opening enclosed by a container lip, a cover held on the container, said cover being movable between a closed position covering the container opening and an open position uncovering the container opening pivoting about a cover swivel axis which extends along a container rear side, and a lock device of the afore-mentioned type.

DESCRIPTION OF THE RELATED ART

It is generally known in the prior art to lock waste receiving devices provided with a swiveling cover, such as waste bins, with a lock device to prevent unauthorized persons from adding waste to the container or removing waste from it. It is also known that the lock device can be designed as a gravity lock. Gravity locks are characterized by the fact that the cover lock caused by it is automatically released when the container is tilted forward from its upright position for emptying. Accordingly, bins being provided with a gravity lock can always be emptied by the refuse collector. Such a gravity lock is the subject of DE 197 08 193 C2, for example. This document describes a lock device which has an upper lock part to be fastened to the cover and a lower lock part to be fastened to the container. The upper lock part comprises an upper lock part housing, a lock accommodated in the upper lock part housing and operable by means of a key, and a first locking element projecting downwards from the upper lock part housing and pivotable about a swivel axis between a locking position and an unlocking position by actuating of the lock. The lower lock part comprises a lower lock part housing in which a second locking element projecting upwards from the lower lock part housing is accommodated, which in its blocking position can cooperate with the first locking element positioned in its locking position in such a way that the cover is locked. In order to enable the container to be emptied in this locked state of the cover, the lower lock part further comprises a weight part operatively connected to the second locking element, which is pivotably received in the lower lock part housing in such a way that it positions the second locking element in an upright position of the container in its blocking position and, when the container is tilted forward for emptying, automatically transfers it into its release position in which it is disengaged from the first locking element positioned in its locking position. In order to prevent the second locking element in the upright position in the container from moving to its release position, an arresting means in the form of a ball is movably accommodated in the lower lock part housing, the ball locking the second locking element in its blocking position in the upright position of the container. More specifically, the ball is movable upwards and downwards within the lower lock part housing in an upright extending rectilinear guide between an upper position and a lower position. In the lower position, the ball prevents the weight part from pivoting. In the upper position, however, it releases the pivoting movement of the weight part.

The lock device disclosed in DE 197 08 193 C2 has basically proved its worth in that it allows the container to be emptied without any problems at any time. However, the locking of the cover, which is effected by the first locking element and the second locking element, is also released if the container tips over due to the action of external forces, for example if the container is caught by a strong dust of wind or is deliberately knocked over by a person.

SUMMARY OF THE INVENTION

Based on this prior art, it is a task of the present invention to create a locking device as well as a waste collection device of the type mentioned above with an alternative design.

To solve this task, the invention creates a lock device of the type mentioned at the beginning, which is characterized in that at least one second arresting means is received movably in the lower lock part housing and is arranged and formed such that it arrests the second locking element in its blocking position, when the container is tilted laterally from its upright position. Thus, in the lock device according to the invention, the cover lock caused by the first locking element and the second locking element is only released when the container is tilted forward. At this point, it should be noted that the terms “front”, “rear” and “side” used in this application, always refer to the container in the upright position, unless expressively stated otherwise.

Preferably, the upper lock part housing and the lower lock part housing define insert chamfers which engage each other when the cover is moved in its closed position and align the first locking element and the second locking element with each other. For example, lower side surfaces of the upper lock part housing can be inclined to each other in a V-shaped manner and, when the cover is transferred to its closed position, engage a recess of the lower lock part housing accessible from above, the side walls of which also have a corresponding V-shaped inclination. Such insert chamfers are advantageous in that even if the cover of the container should warp slidely, proper locking of the cover is still possible without any problems.

According to an embodiment of the present invention, the upper lock part housing is composed of an outer housing element projecting outwardly from the cover and an inner housing element projecting inwardly from the cover, the locking mechanism being arranged on the outer housing element and the first locking element together with its swivel axis being arranged on the inner housing element. In this way, a very simple and easy to assemble design of the upper lock part housing is achieved.

Preferably, a bar being pivotable about a swivel axis by actuation of the locking mechanism is provided in the outer housing element, said bar cooperating with an actuating section of the first locking element arranged on the inner housing element, which actuating section projects upwards into the outer housing element. In this way, a very stable design of the lock device is achieved.

According to an embodiment of the present invention, the first arresting means is provided in the form of a ball which is movable upwards and downwards guided in a guide within the lower lock part housing between an upper position and a lower position and which blocks the pivoting movement of the weight part in its lower position and releases the weight part in its upper position.

Preferably, the guide surface of the guide of the first arresting means is pros vided at its rear side with an obstacle which is formed such it prevents or at least makes it more difficult for the first arresting means to move from the lower position in the upper position, when the container is tilted backwards from the upright position to a lying position. Such an obstacle may, for example, be formed by a rib projecting from the actual guide surface, which prevents the ball from moving to the upper position when the container is tilted backwards. Alternatively, it is also possible to provide the rear guide surface with an inclination that prevents or at least hinders the ball from moving to the upper position when the container is tilted backwards.

According to an embodiment of the present invention, the second arresting means is provided in the form of a ball movably guided within the lower lock part housing in a substantially T-shaped guide, which has a substantially upright extending guide section and two guide sections branching off to both sides thereof at the lower end and extending substantially laterally, the ball releasing the pivoting movement of the weight part only when it is positioned at the upper end of the substantially upright extending guide section. Accordingly, an inadvertent opening in the event of lateral tilting of the container is safely prevented.

Preferably, the substantially laterally extending guide sections are bent upwards in an anchor-like manner, thus ensuring even better proper functioning of the lock device in the event of a lateral tilting of the container.

Advantageously, two second arresting means in the form of balls guided in the T-shaped guide are provided. It has been found out that a single ball within the T-shaped guide can jump uncontrolled in the event of a hard impact after the container has been tilted laterally, i.e. also into the essentially upright extending guide area, which would result in the cover lock being released. The second ball safely prevents such uncontrolled jumping.

According to an embodiment of the present invention, the first locking element is pretensioned via a spring element in the direction of its locking position in such a way that the transfer of the first locking element from the locking position into the unlocking position is effected by actuating the locking mechanism against the spring force of the spring element. This results in a very simple handling of the lock device.

Preferably, a third arresting means is movably received in the upper lock part housing, in particular in the inner housing element, said third arresting means being arranged and designed in such a way that it arrests the first locking element in the locking position, when the container is tilted laterally from the upright position into a lying position. It has been found out that the spring element can collapse and swing away uncontrollable when the container hits the ground after being tilted laterally. In such a case, the third arresting means reliably prevents uncontrolled opening of the cover.

Preferably, the third arresting means is provided in the form of a ball which is movably guided in the upper lock part housing, in particular inside the inner housing element, in a laterally extending guide between a lower position and an upper position, and which arrests, when in the upper position, the first locking element in its locking position, the ball in particular cooperating with the weight part. In this way, a very simple design is achieved.

Furthermore, the present invention provides for the solution of the abovementioned task a waste collection device comprising a container having on its upper side a container opening enclosed by container lip, a cover held on the container, said cover being movable between a closed position covering the container opening and an open position uncovering the container opening pivoting about a cover swivel axis which extends along a container rear side, and a lock device according to the invention.

BRIEF DESCRIPTION OF THE DRAWINGS

Further features and advantages of the present invention are illustrated by the following description of a waste collection device according to an embodiment of the present invention with reference to the enclosed drawing. In it shows.

DESCRIPTION OF THE PREFERRED EMBODIMENTS

Figure 20:
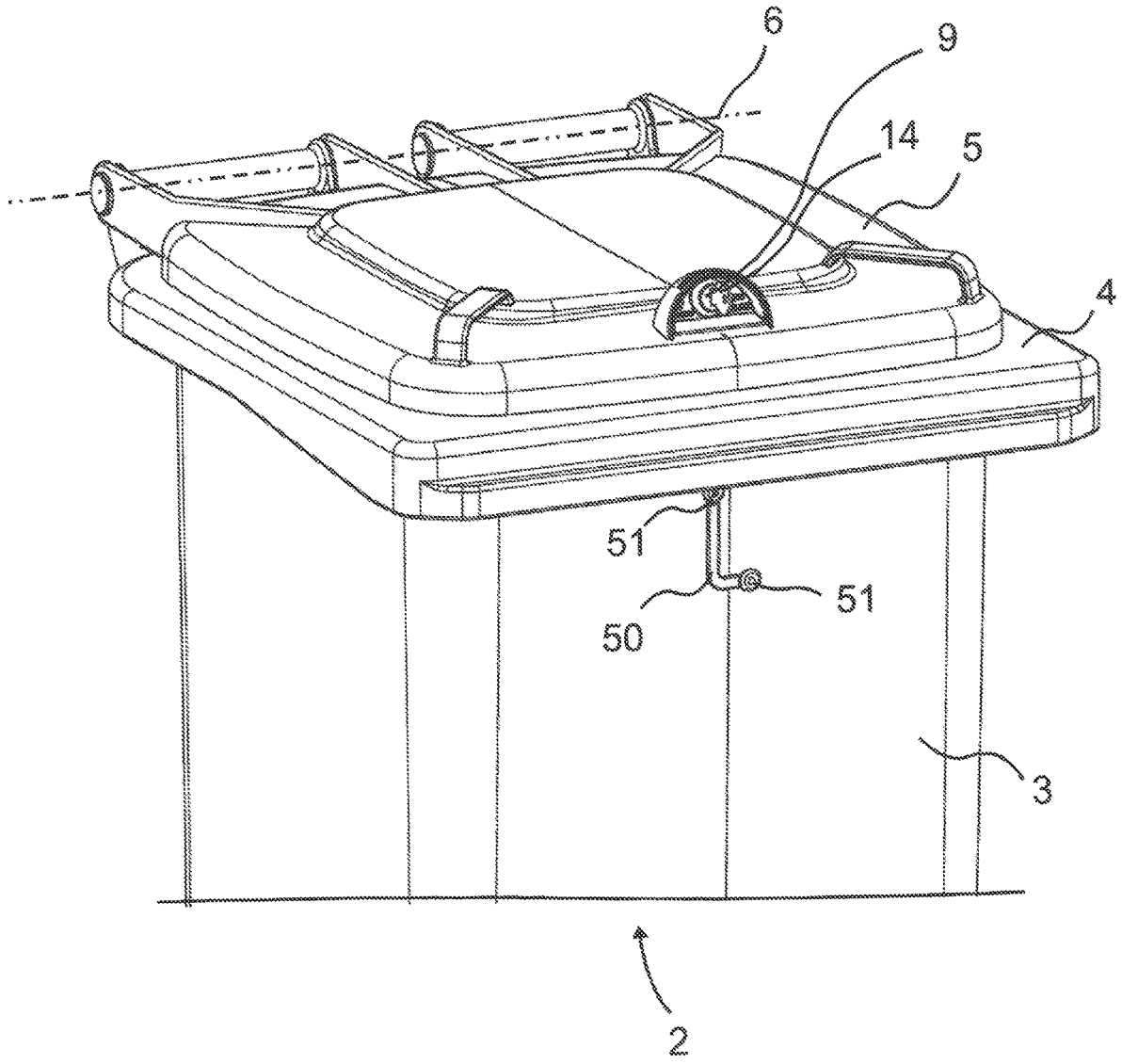
FIG. 20 a partial perspective view of a waste receiving device with a lock device attached thereto, the cover of the waste receiving device being in its closed position.
Figure 21:
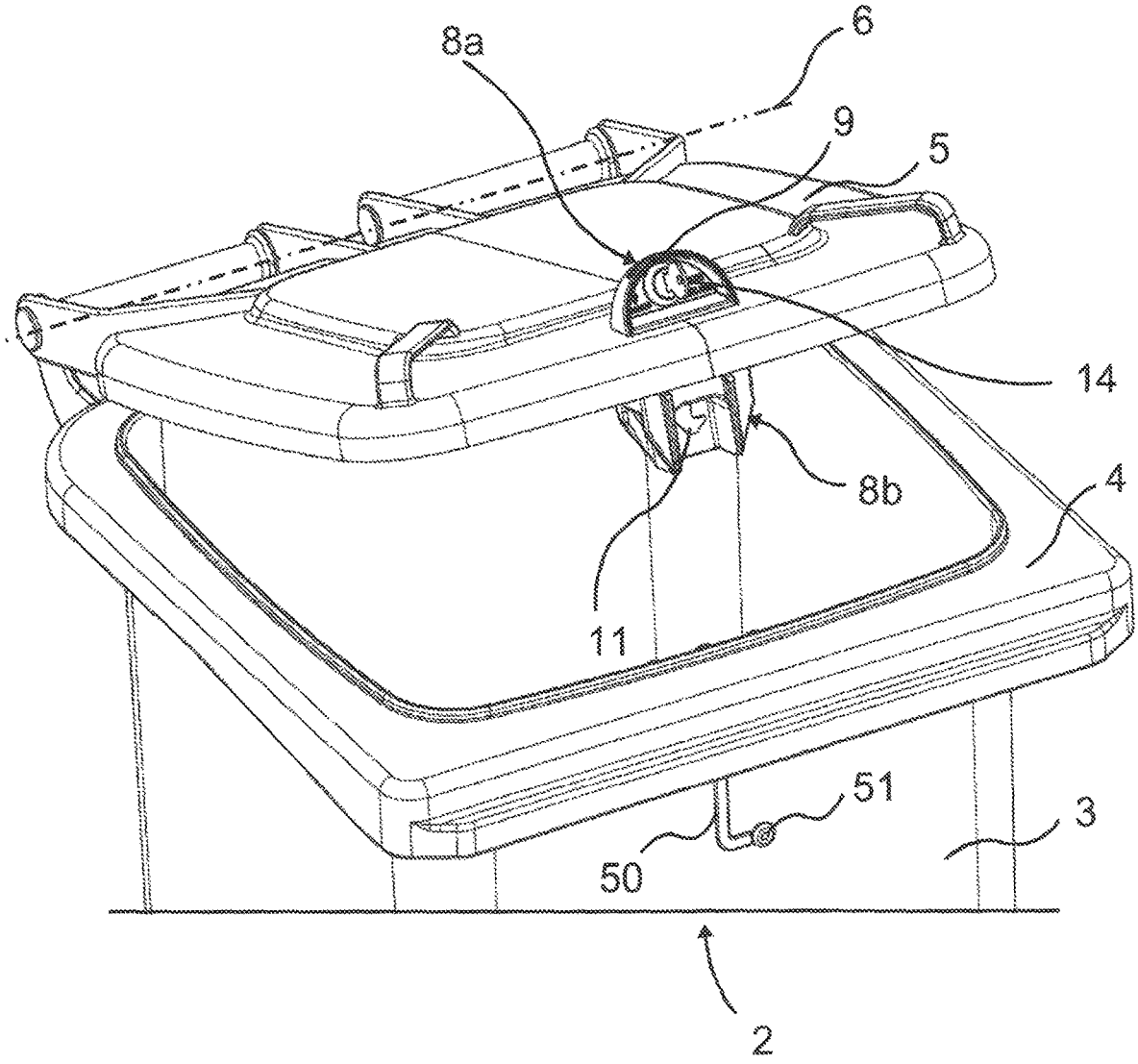
FIG. 21 a perspective view showing the waste receiving device with a cover in its open position.
Figure 22:
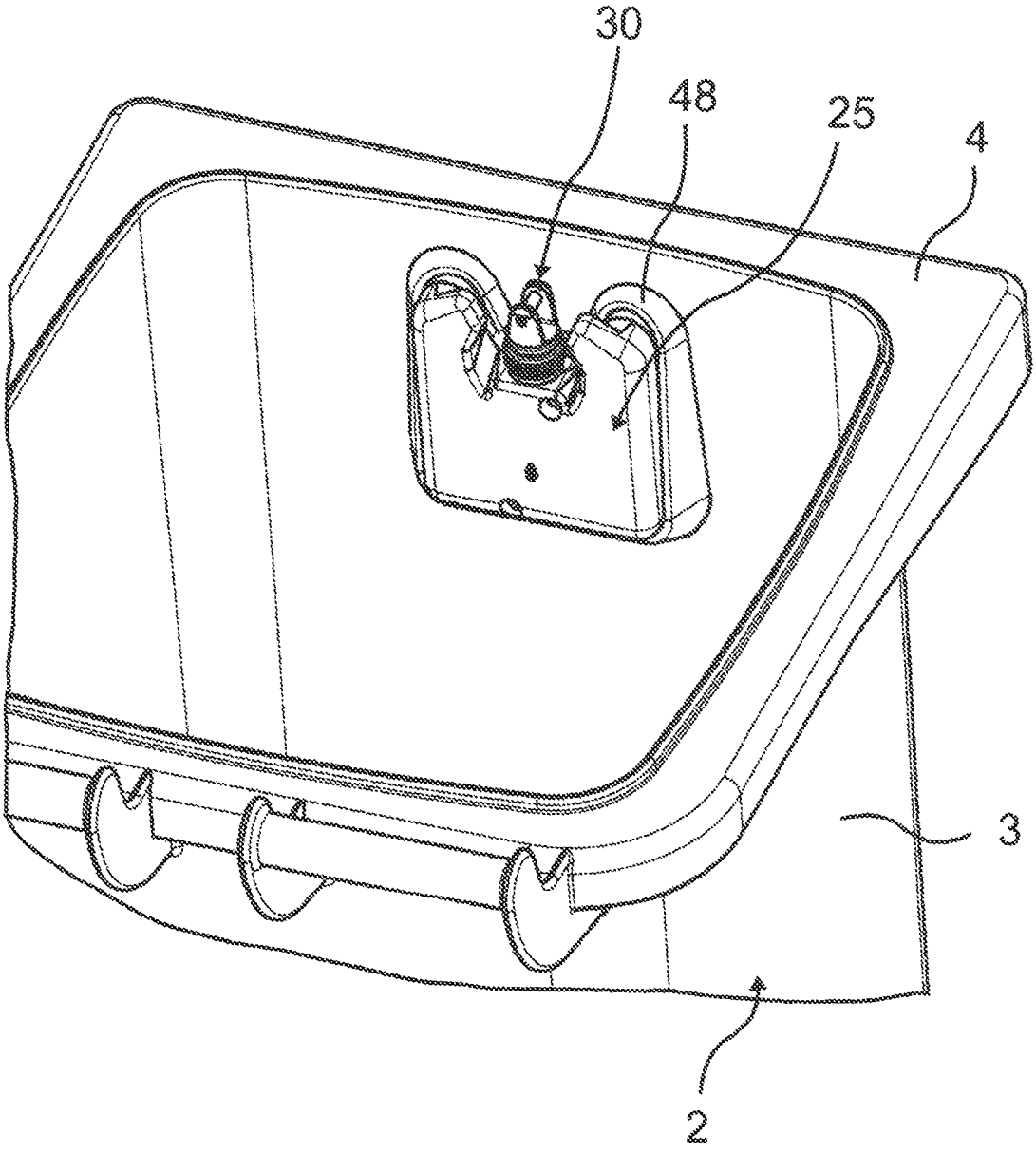
FIG. 22 a rear view of the front container wall to which the lower lock part is attached.

FIGS. 1 to 19 show a lock device 1 according to an embodiment of the present invention or components thereof. The lock device 1 is intended to be mounted, as shown in FIGS. 20 to 22, on a waste receiving device 2 comprising a container 3 defining at its upper side a container opening enclosed by a container lip 4 and a cover 5 held on the container 3, said cover 5 able to be moved between a closed position closing the container opening and an open position uncovering the container opening by pivoting about a cover swivel axis 6 which extends along a container rear side. The lock device 1 serves to lock the cover 5 in its closed position.

Figure 1:
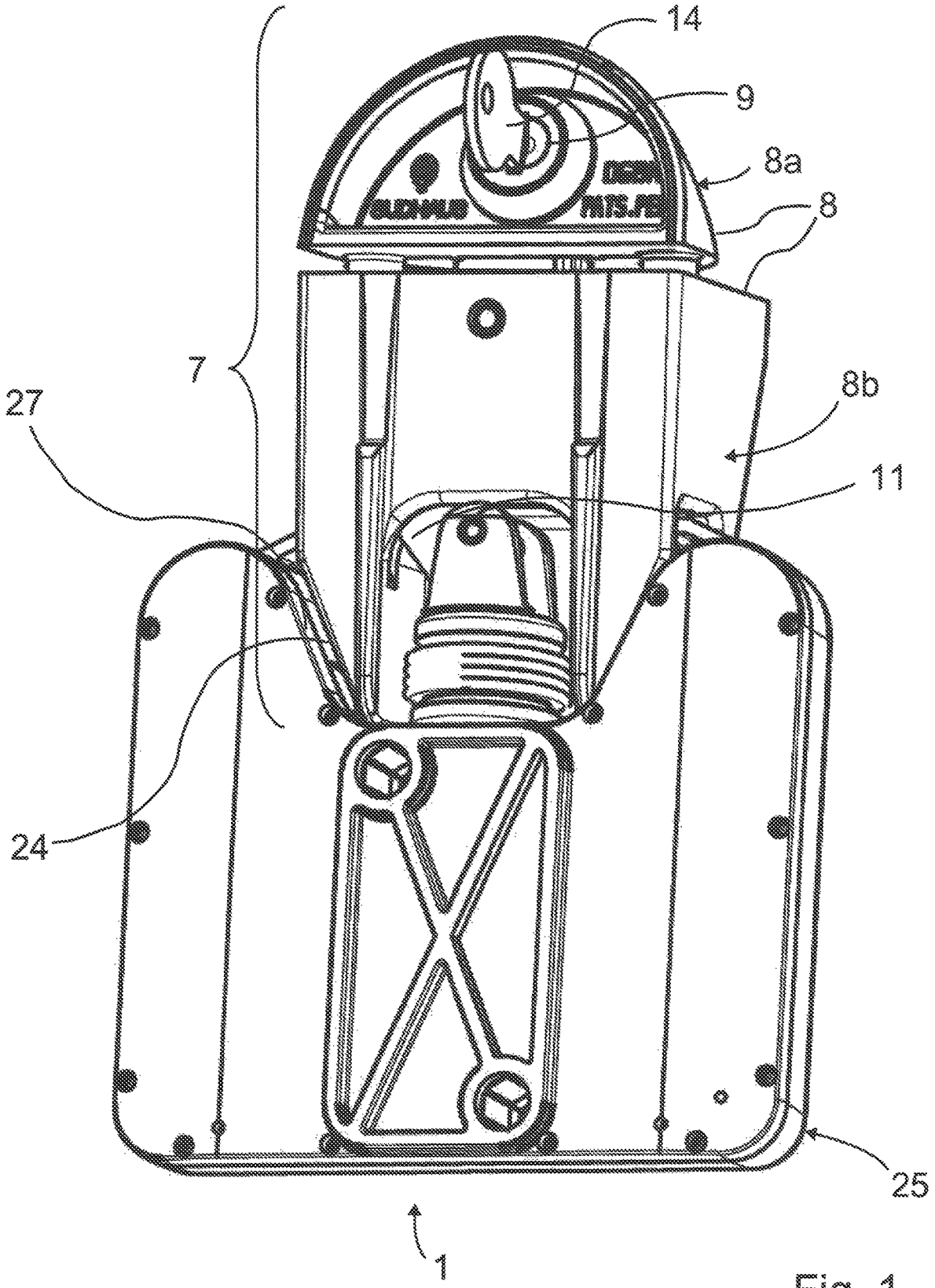
FIG. 1 a front view of a lock device according to an embodiment of the present invention.
Figure 2:
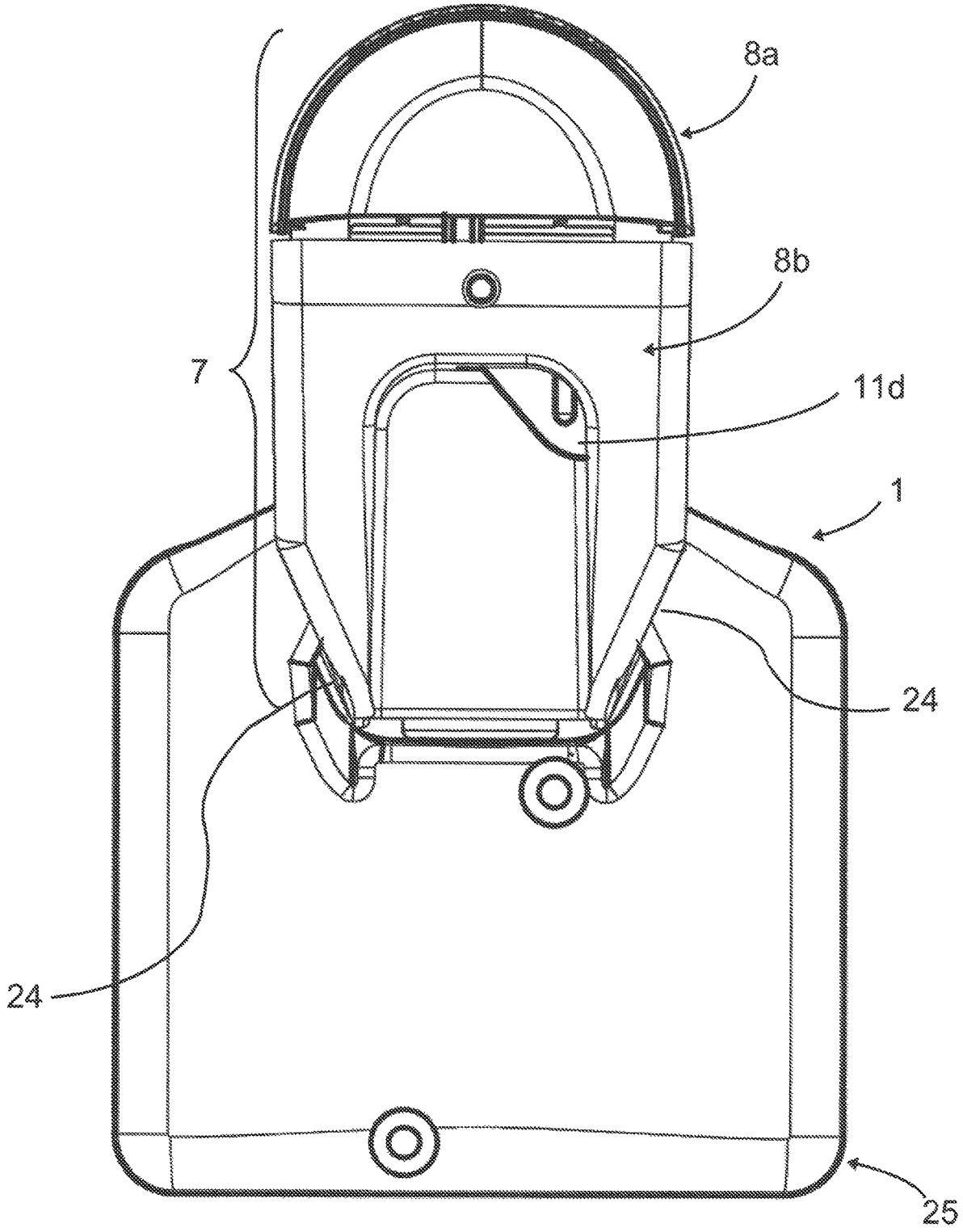
FIG. 2 rear view of the device shown in FIG. 1.
Figure 3:
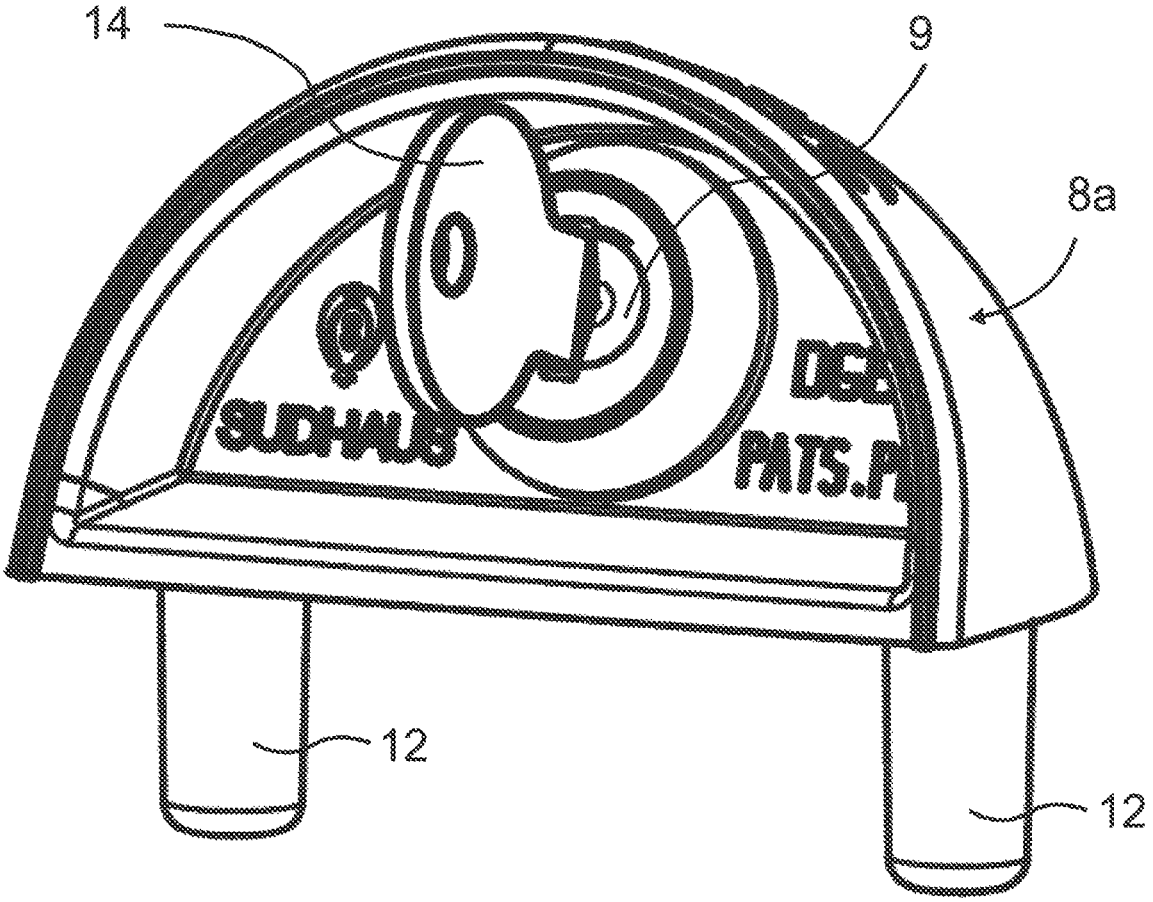
FIG. 3 a perspective front view of an outer housing part of an upper lock part housing of an upper housing part of the lock device.
Figure 4:
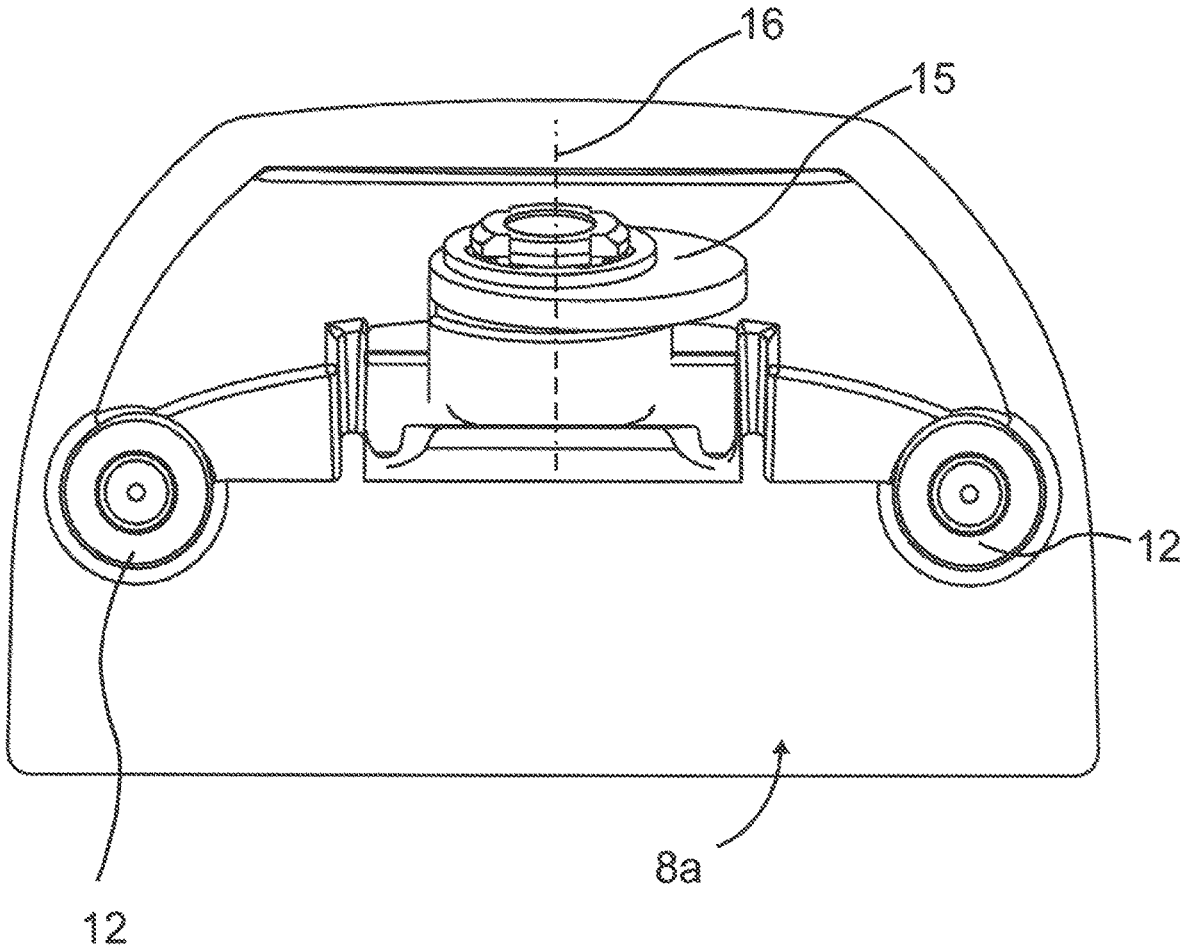
FIG. 4 a perspective bottom view of the outer housing part shown in FIG. 3.
Figure 5:
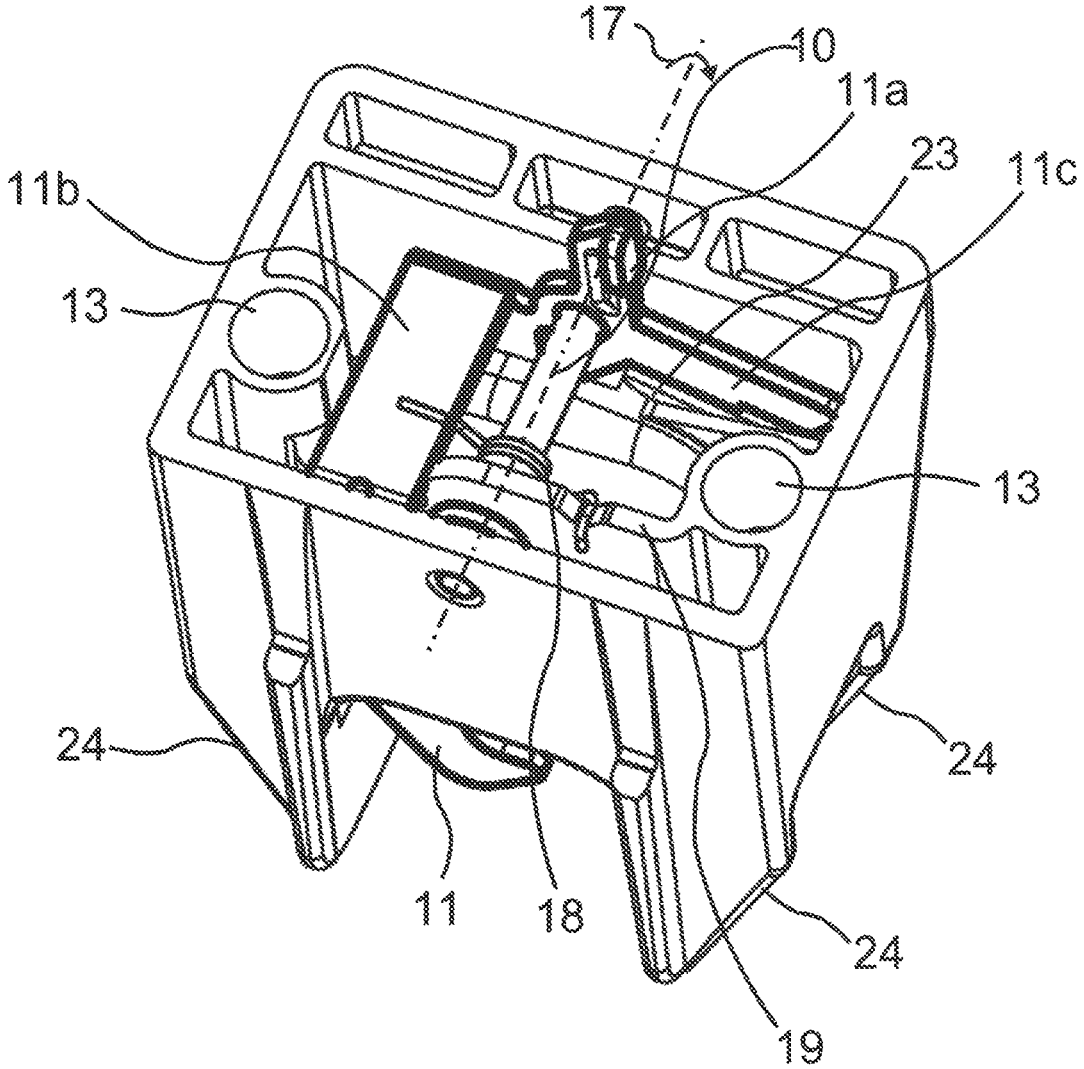
FIG. 5 a perspective front top view of an inner housing part of an upper lock part housing of an upper lock part of the lock device with a first bar element in a locking position.
Figure 6:
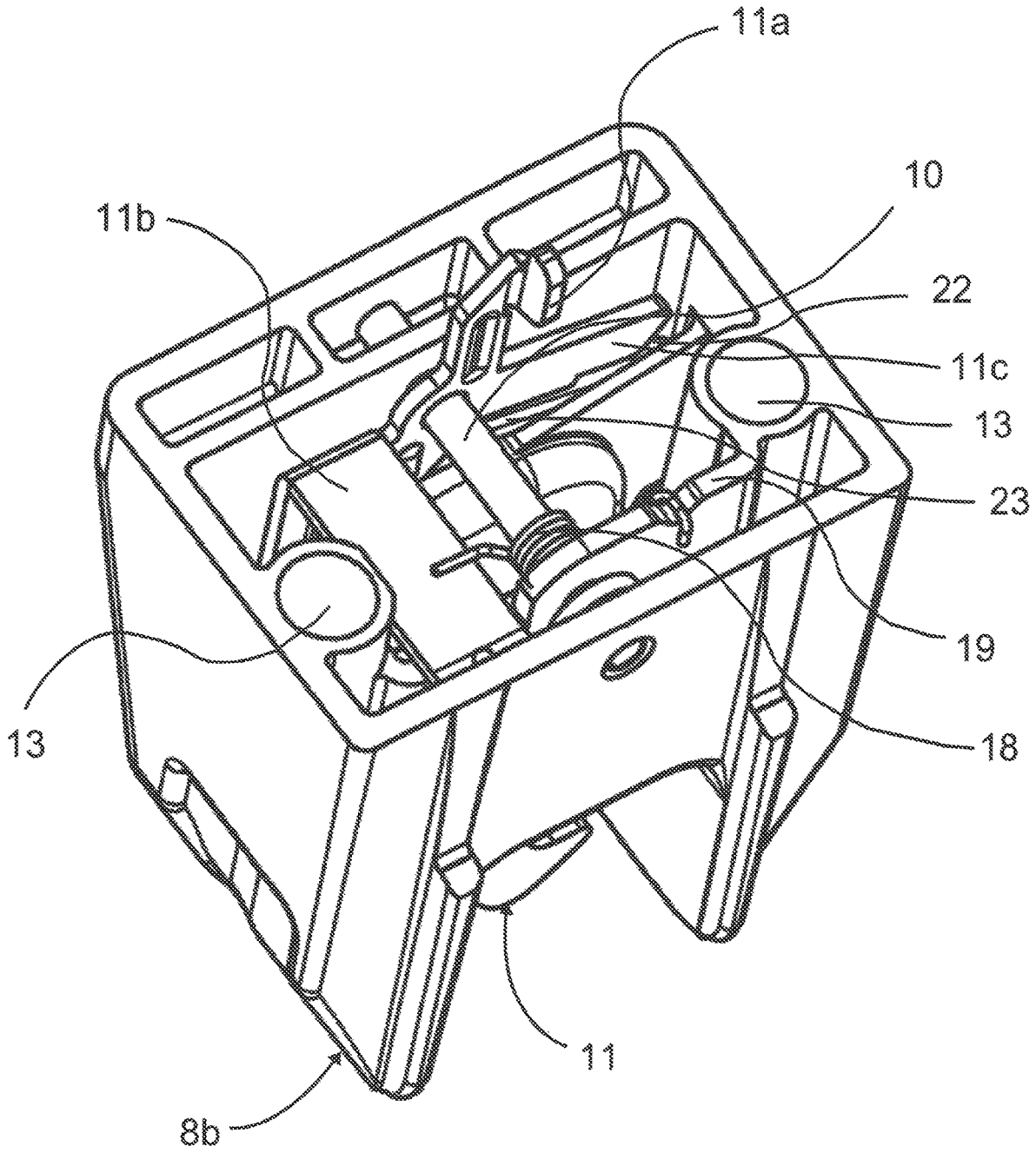
FIG. 6 a perspective side plan view of the inner housing part.
Figure 7:
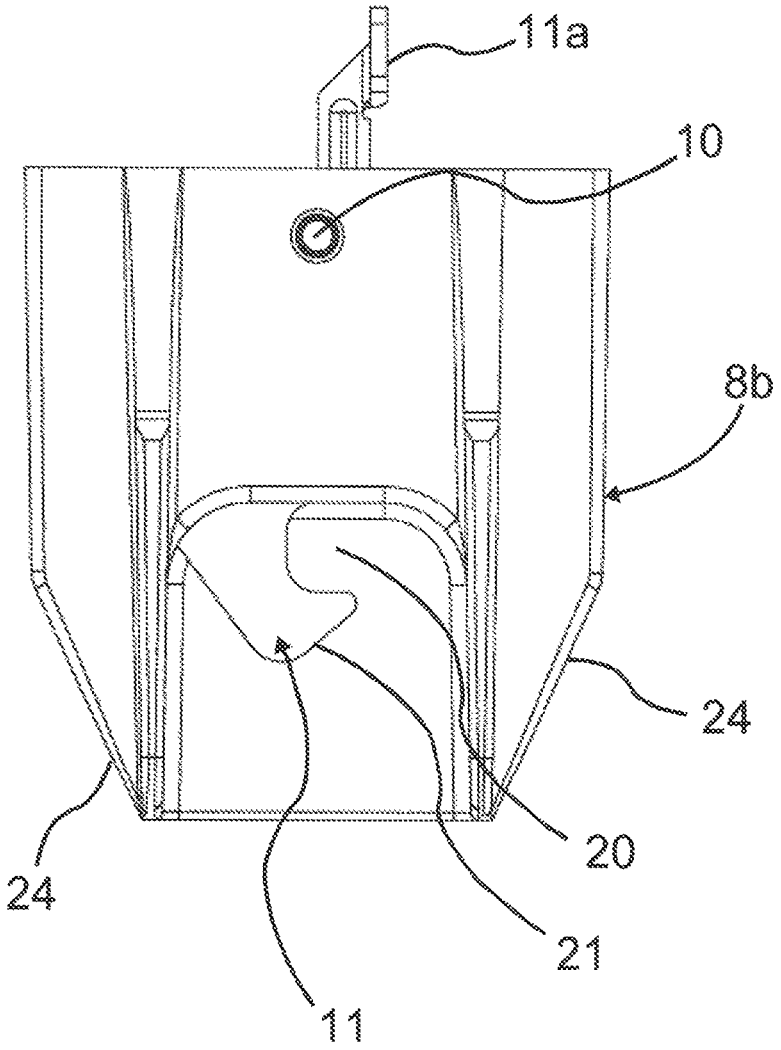
FIG. 7 a front view of the inner housing part.
Figure 8:
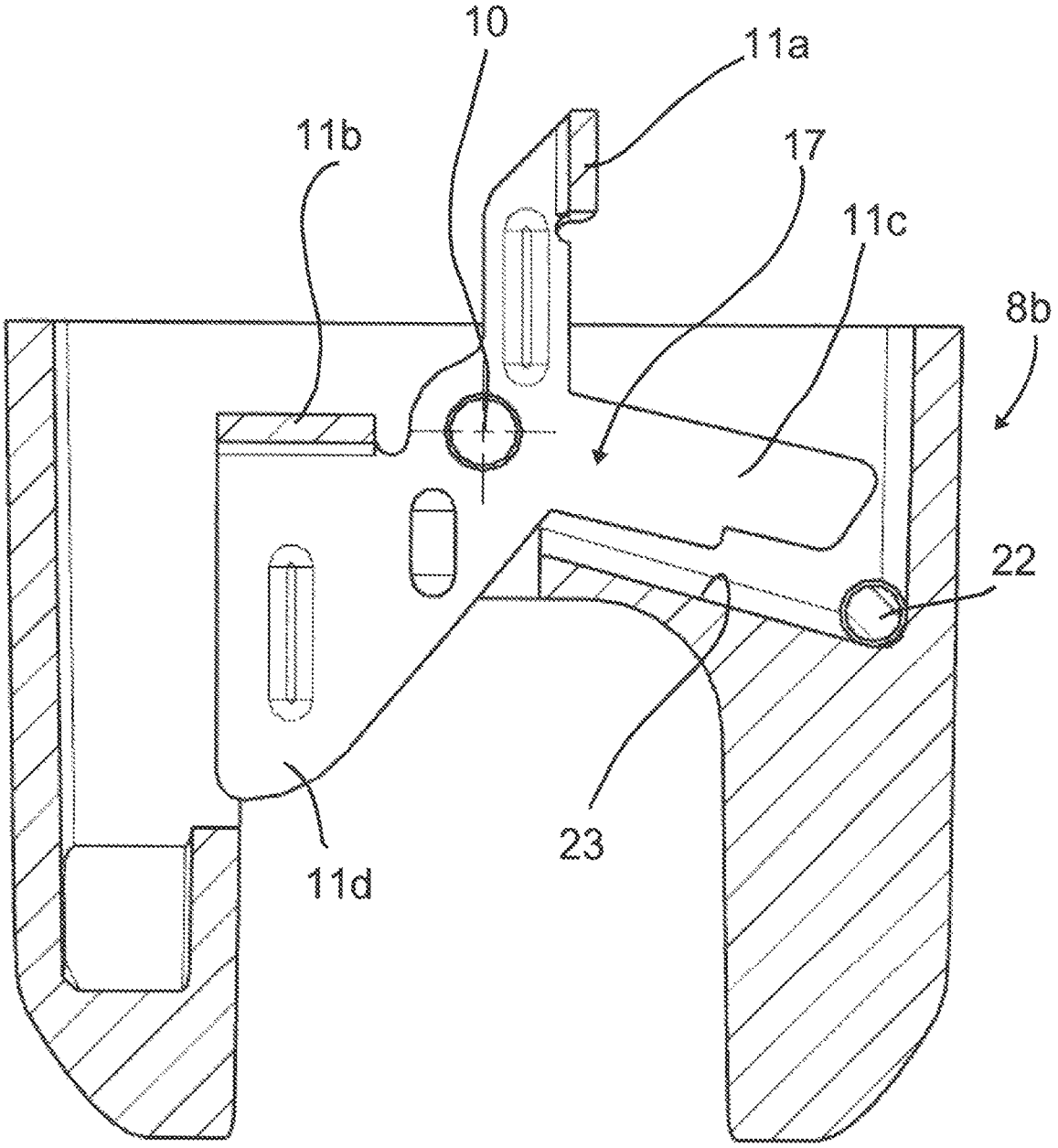
FIG. 8 a sectional view along the line VIII-VIII in FIG. 6.
Figure 9:
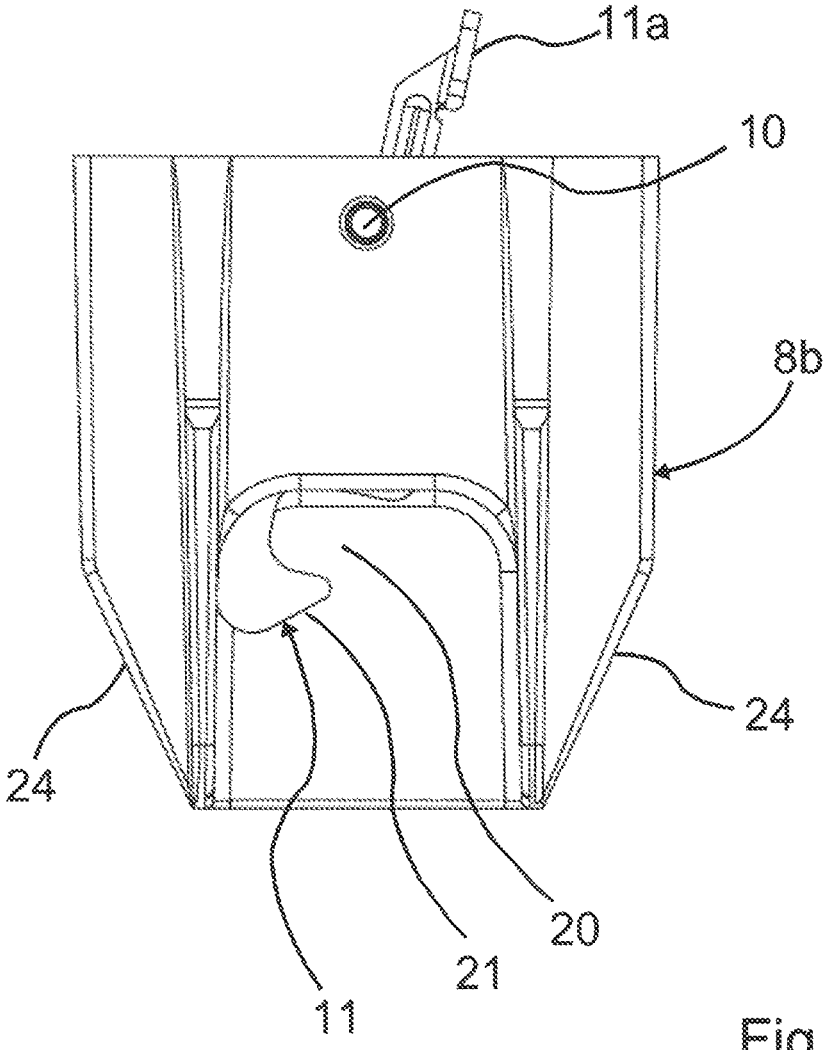
FIG. 9 a front view of the inner housing part with a first locking element in an unlocked position.
Figure 10:
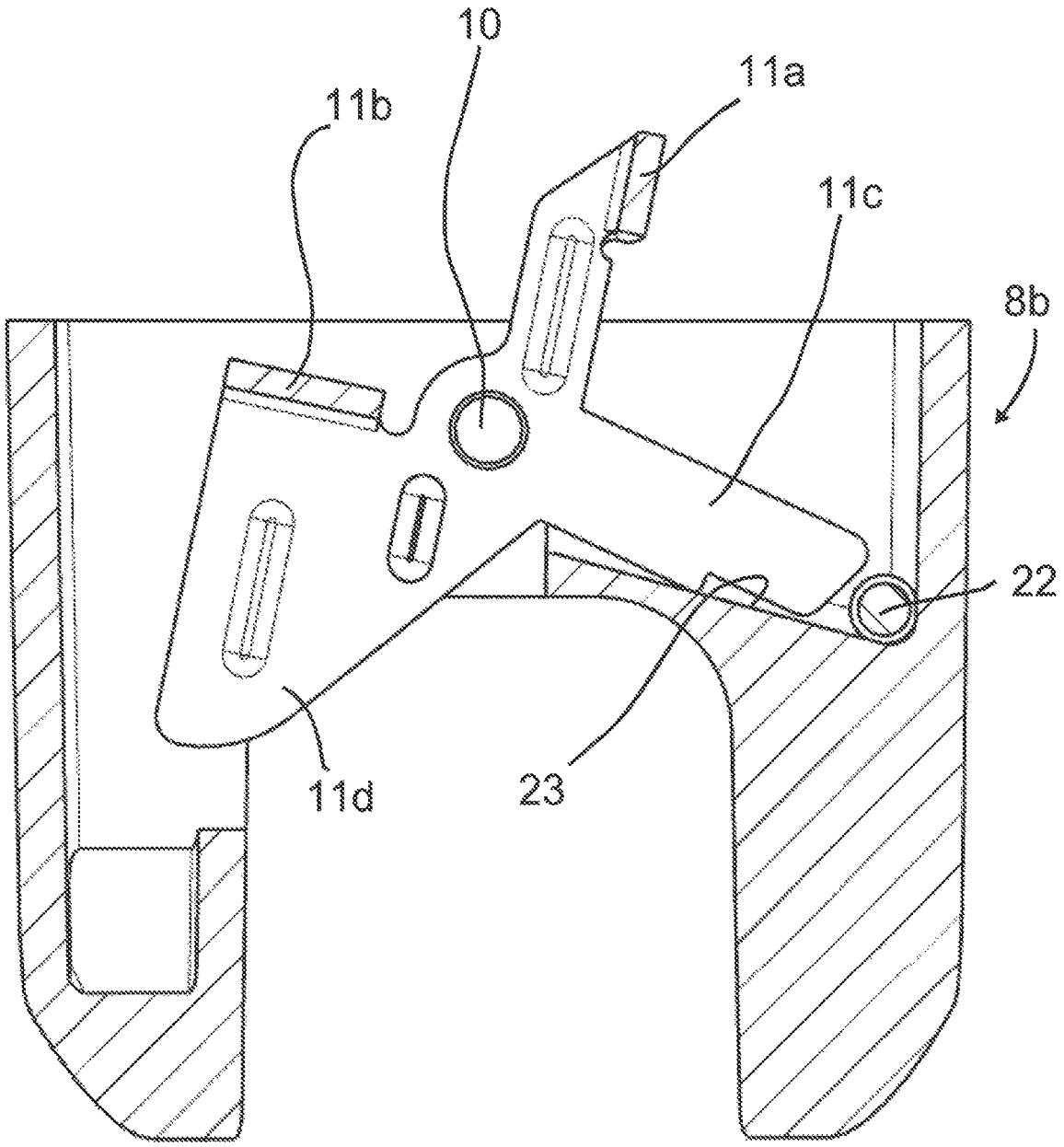
FIG. 10 a sectional view similar to FIG. 8 with the first locking element in its unlocking position.
Figure 11:
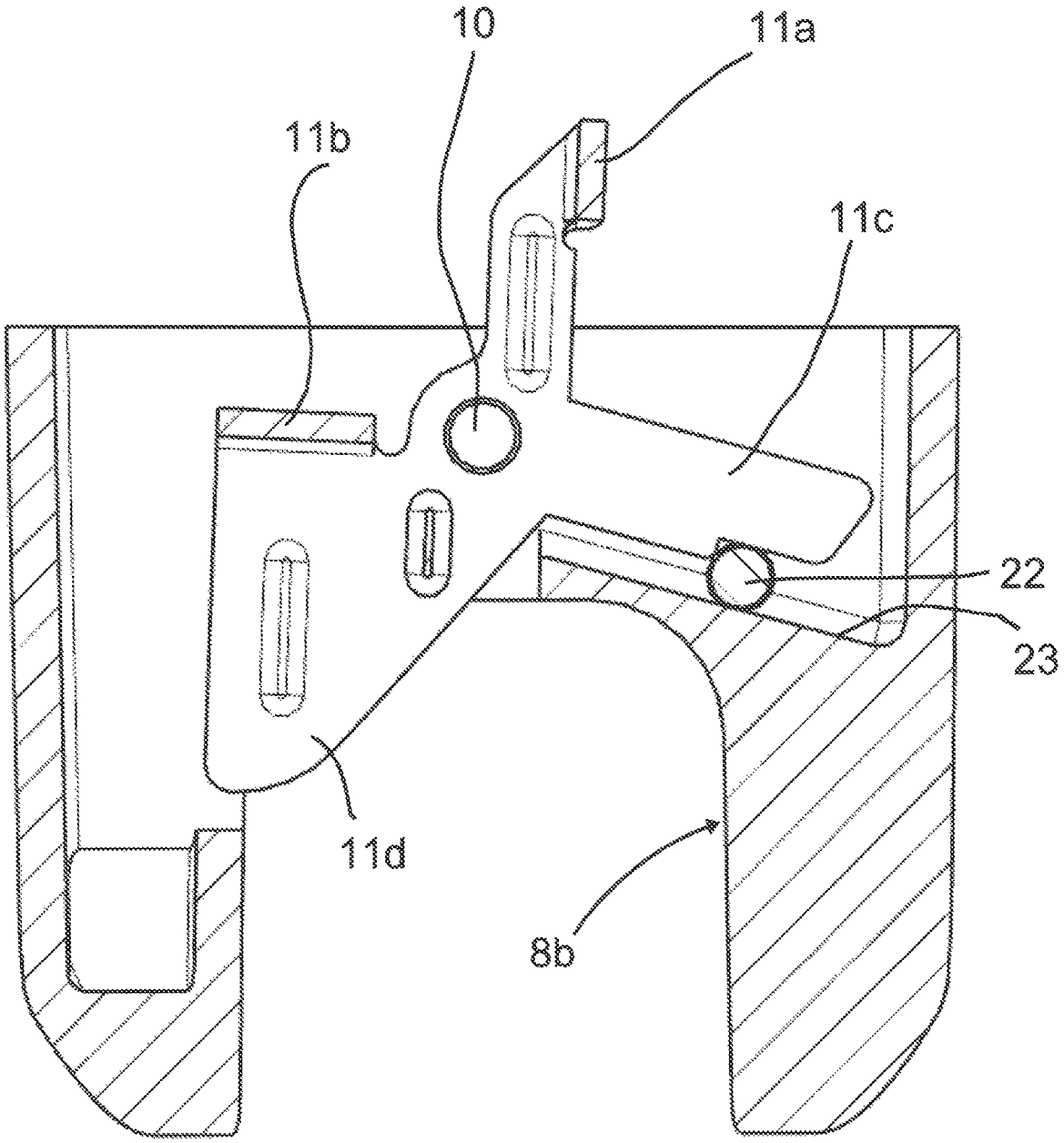
FIG. 11 a sectional view similar to FIG. 8 after the arrangement shown in FIG. 8 has been tilted laterally to the left.

The lock device 1 comprises an upper lock part 7 to be fastened to the cover 5 of the container 3 of the waste receiving device 2, said upper lock part 7 comprising as main components an upper lock part housing 8, a locking mechanism 9 accommodated in the upper lock part housing 8 and a first locking element 11 projecting downwards from the upper lock part housing 8 and pivotable about a swivel axis 10 between a locking position and an unlocking position by actuating the locking mechanism. The upper lock part housing 8 is composed of an outer housing element 8*a* and an inner housing element 8*b*. When the lock device is attached to the waste receiving device 2, the outer housing element 8*a* projects outwards and the inner housing element 8*b* projects inwards from the cover 5 of the waste receiving device 2. The housing parts 8*a* and 8*b* are connected via screw-on mandrels 12 projecting downwards from the outer housing element 8*a*, said screw-on mandrels 12 engage from above in associated mandrel receptacles 13 of the inner housing element 8*b*. The outer housing element 8*a* accommodates the locking mechanism 9 which can be operated with a key 14. At the inner end of the locking mechanism 9, a bar 15 is mounted so as to be rotatable about a swivel axis 16 defined by the locking mechanism 9, said swivel axis 16 in this case extending parallel to the swivel axis 10 of the first locking element 11, see for example FIG. 5. The bar 15 interacts with an actuating section 11*a*, which extends upwards from the inner housing part 8*b* into the outer housing part 8*a*, of the first locking element 11 positioned on the inner housing element 8*b*. When the key 14 shown in FIG. 1 is turned to the left, the bar 15, viewing FIG. 5 from the left, presses against the actuating section 11*a* of the first locking element 11, causing the first locking element 11 to pivot in the direction of the arrow 17 to the right from the locking position of the first locking element 11 shown in FIGS. 5 to 8 about the swivel axis 10 to its unlocking position shown in FIGS. 9 and 10. This pivoting movement takes place in the present case against the spring force of a spring element 18 in the form of a latch spring which presses the first locking element 11 into its locking position. For this purpose, the spring element 18, which in this case is formed with two spring legs projecting to opposite sides, is supported by one spring leg on the upper side of a supporting wall 19 of the inner housing element 8*b* and by the other spring leg on the upper side of a supporting section 11*b* of the first locking element 11 extending parallel to the swivel axis 10, which support section 11*b* extends in a horizontal plane in the locking position of the first locking element 11 and connects the first locking element 11 with its actuating section 11*a*. The free end of the first locking element 11, which projects downwards from the inner housing element 8*b* at the front side, is hook-shaped and defines an engagement opening 20 at its side facing in the direction of its locking position. At the bottom side, the free end of the first locking element 11 is provided with a contact surface 21, which is inclined obliquely upwards and whose function is explained in more detail below. The inner housing element also movably accommodates an arresting means 22, which is arranged and designed in such a way that it blocks the first locking element 11 in the locking position when the container 3 shown in FIGS. 20 to 22 is tilted from the upright position in the locking pivot direction, i.e. in the opposite direction to the arrow shown in FIG. 5, to a lying position. 15*s* In the present case, the arresting means 22 is provided in the form of a ball which is guided inside the inner housing element 8*b* in a laterally extending guide 23 inclined downwards towards the outside of the inner housing element 8*b* and movable between a lower position and an upper position. The arresting means 22 interacts with a blocking section 11*c* of the first locking element 11 which blocking section 11*c* extends substantially parallel to the guide 23 above the latter, but is shorter than the guide 23. When the container 3 of the waste receiving device 2 is in its upright position, the arresting means 22 remains in the lower position defined by the guide 23 as shown in FIG. 8. When the container 3 is tilted to the left from the position shown in FIG. 8, the arresting means 22 also rolls along the guide 23 to the left and slides under the blocking section 11*c* of the first locking element 11 as shown in FIG. 9. In this position, the arresting means 22 blocks the first locking element 11 in the locking position, as it prevents the first locking element from pivoting towards its unlocking position. An emergency unlocking section 11*d* of the locking element 11 projects downwards from the inner housing element 8*b* of the upper lock part housing 8. If this emergency unlocking section 11*d* is pressed, this leads to an unlocking of the cover 5. For example, a person trapped in container 3 can free himself by pressing the emergency unlocking section 11*d*. In the lower area of the inner housing element 8*b*, two lateral insert chamfers 24 are formed on the outside of the housing, which are inclined to each other in a V-shape.

Figure 12:
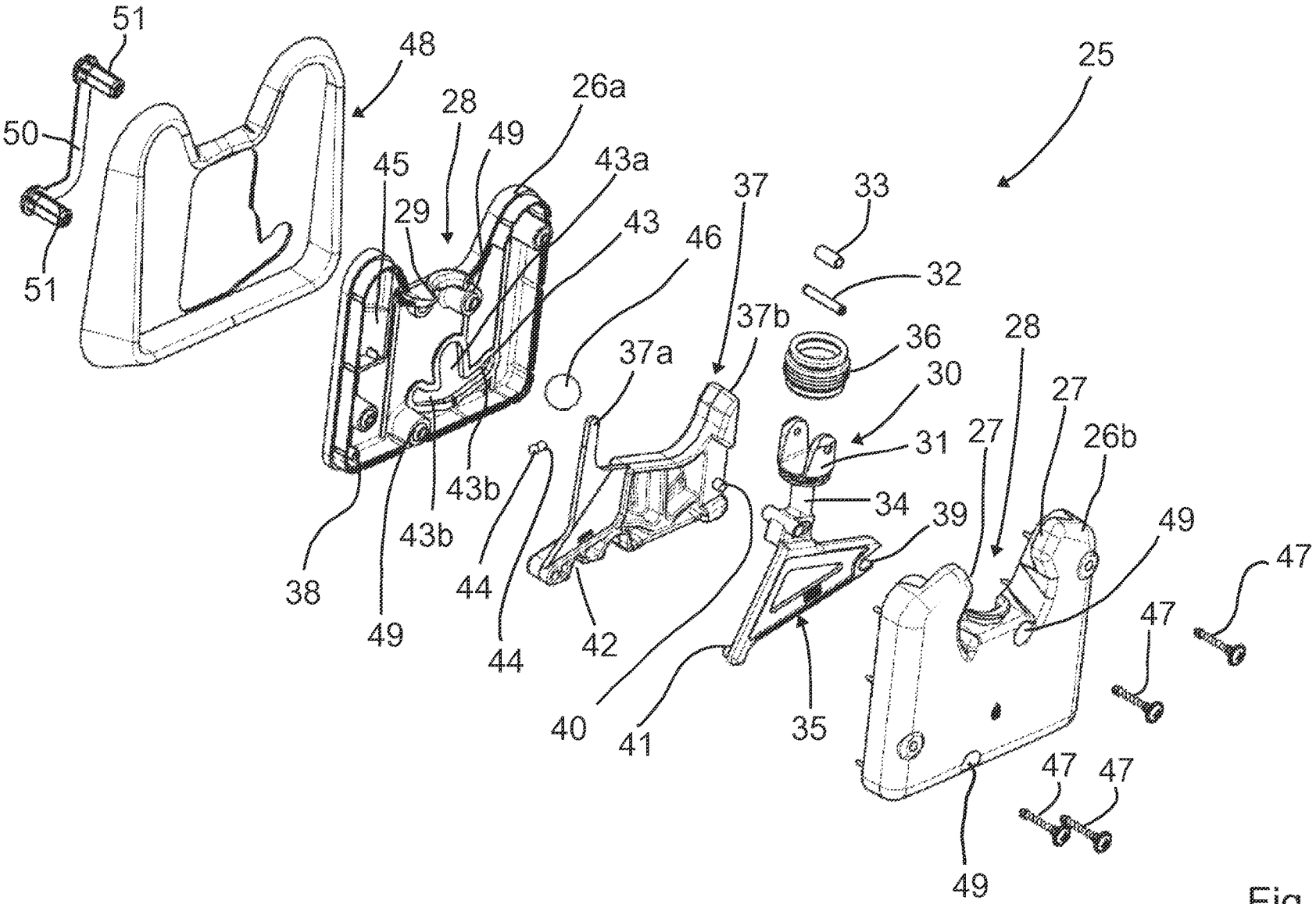
FIG. 12 a perspective rear exploded view of a lower lock part of the lock device.
Figure 13:
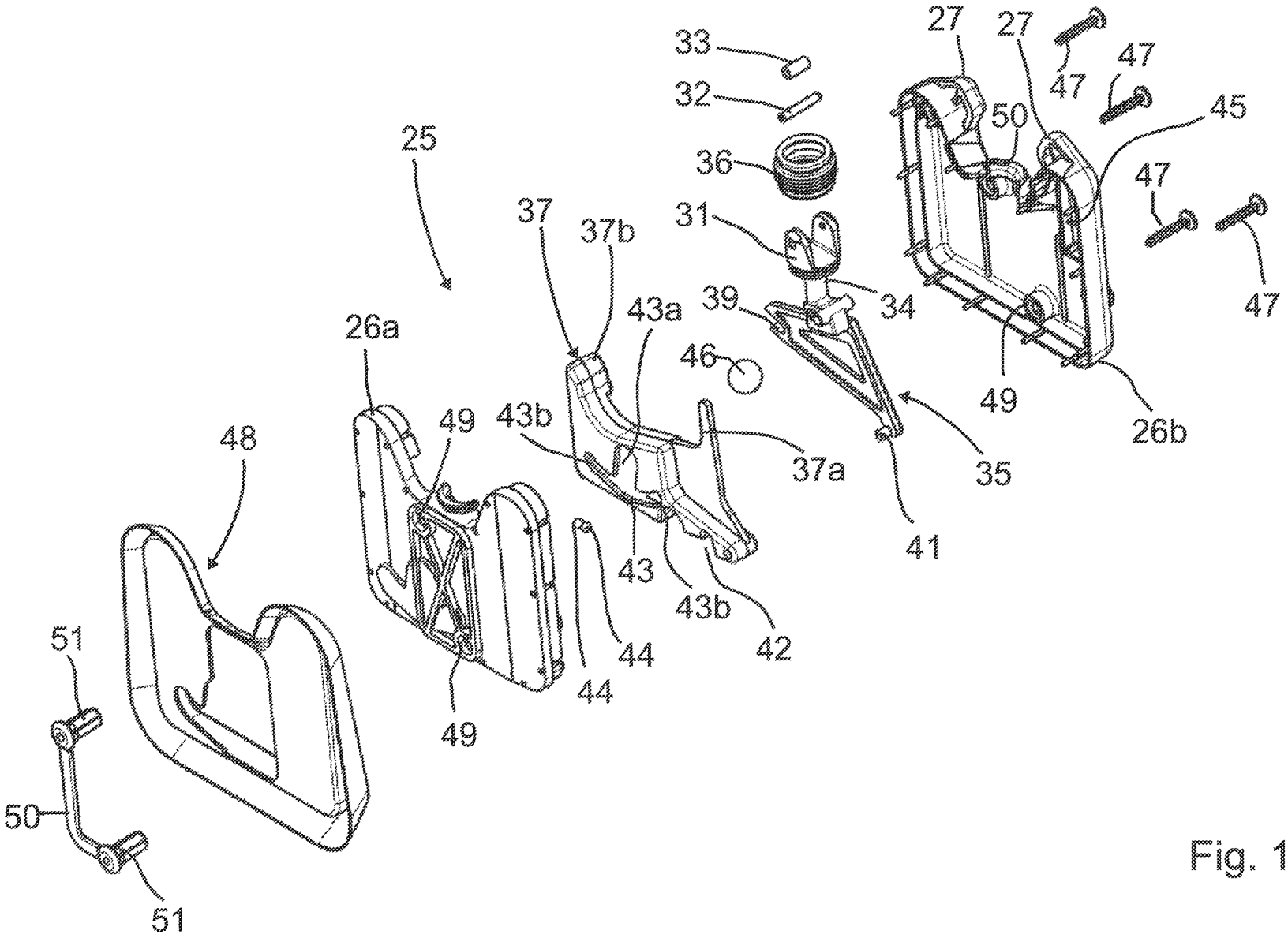
FIG. 13 a front exploded view of the lower lock part housing.
Figure 14:
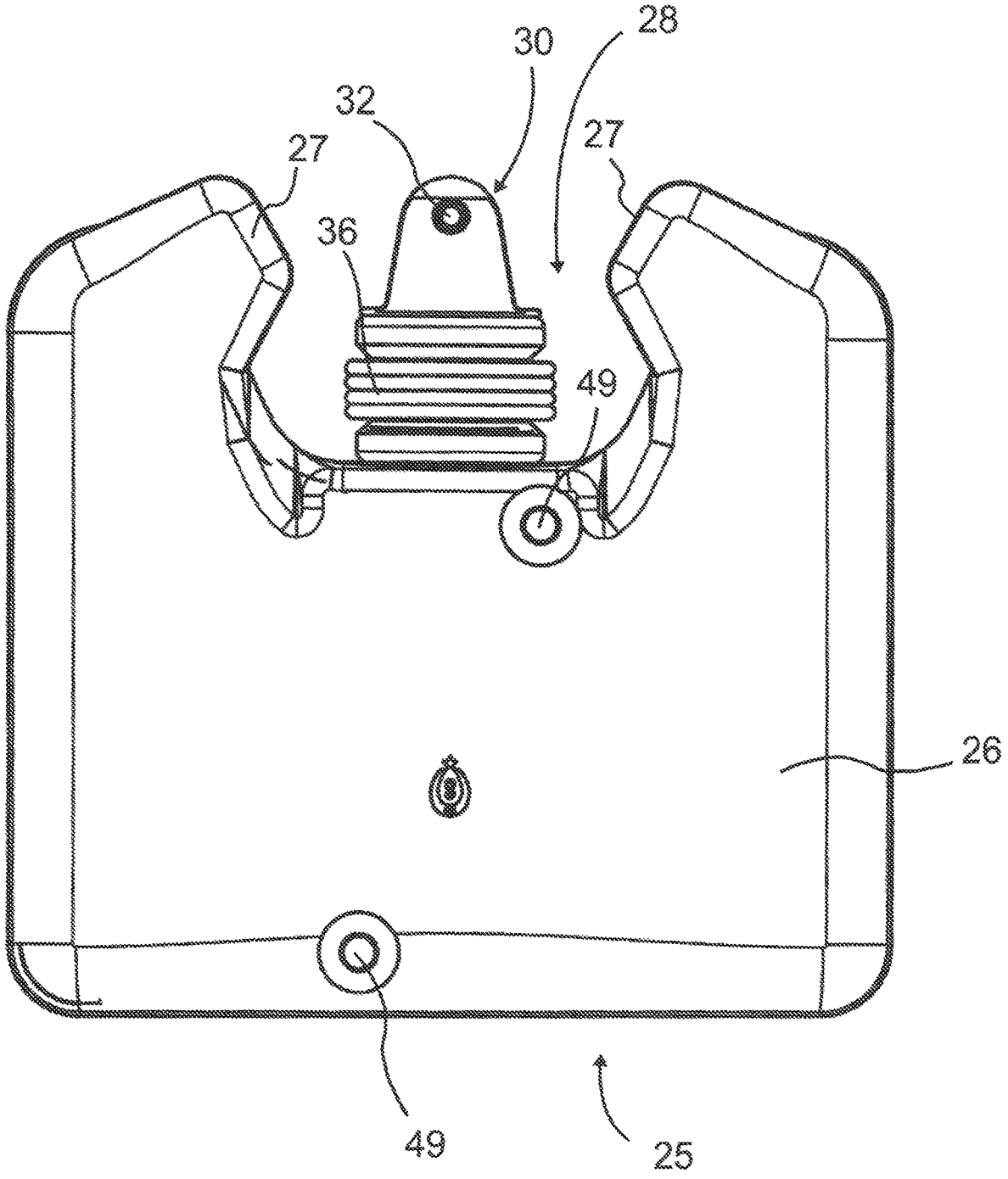
FIG. 14 a rear view of the lower lock part housing with a second locking element in a blocking position.
Figure 15:
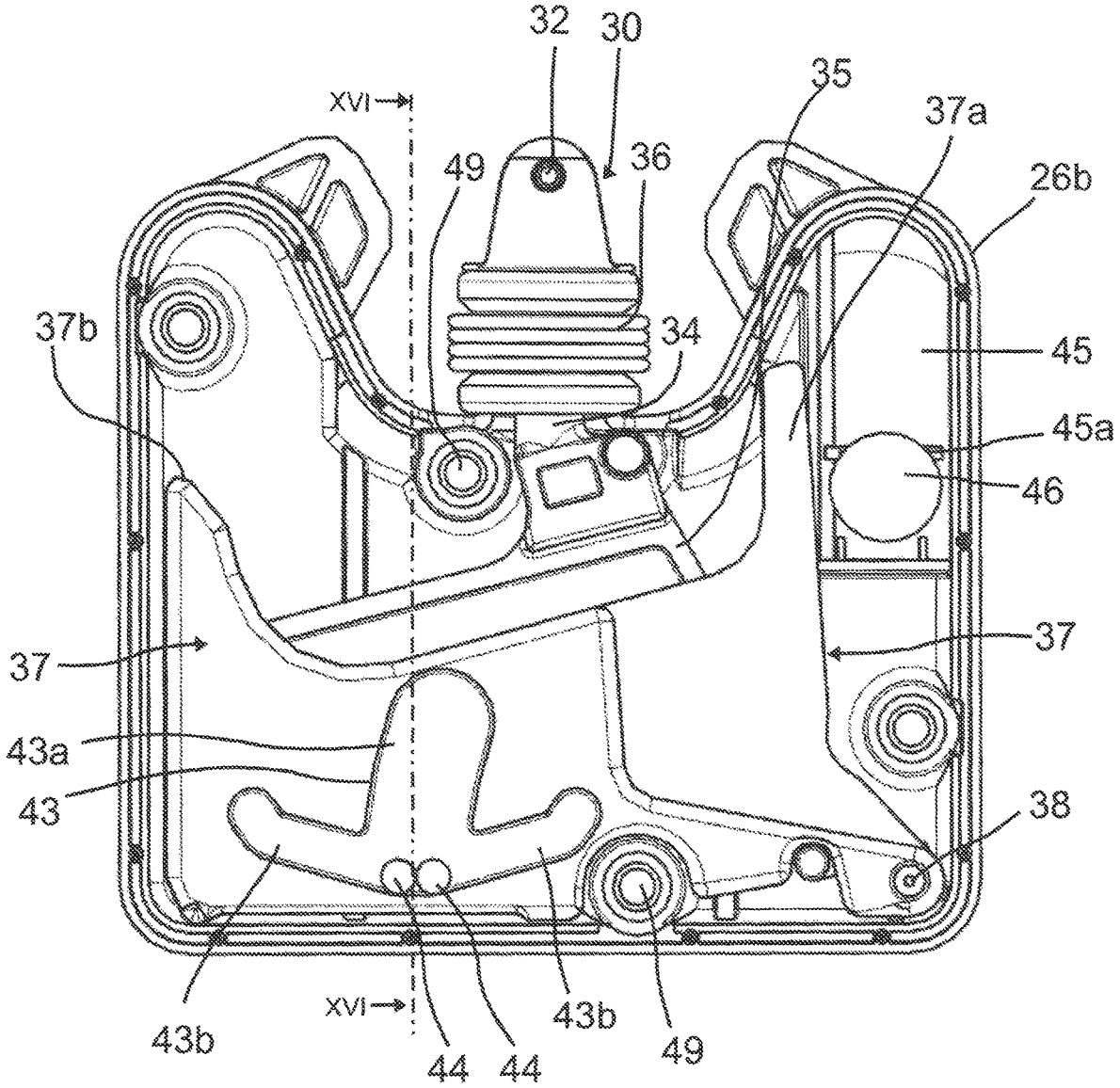
FIG. 15 a sectional view of the lower lock part housing as viewed from the front with the front half of the housing removed and the second locking element in its blocking position.
Figure 16:
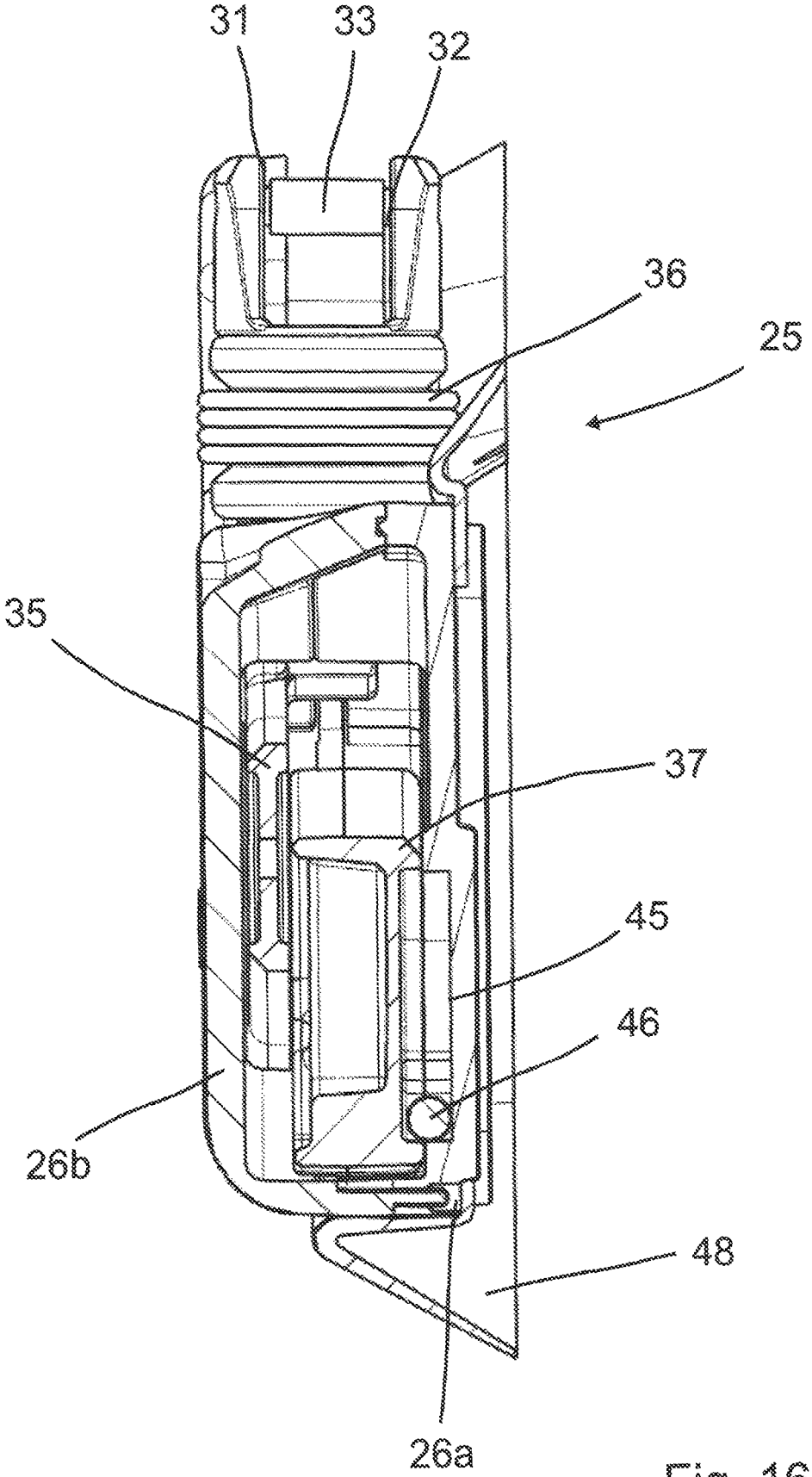
FIG. 16 a sectional view along line XVI-XVI in FIG. 15.
Figure 17:
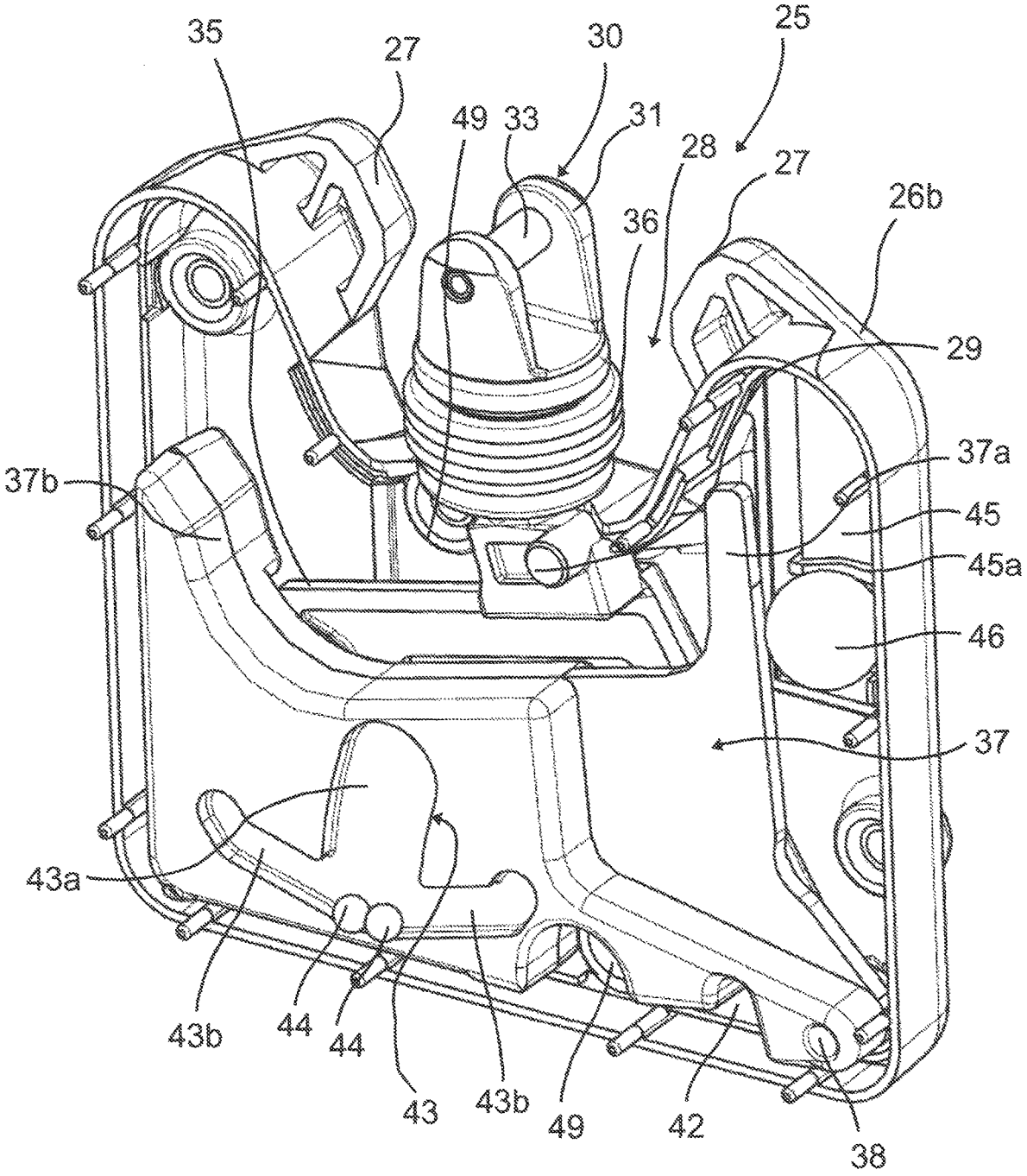
FIG. 17 a perspective front view of the lower lock part housing with a front half of the housing removed and the first locking element in its blocking position.
Figure 18:
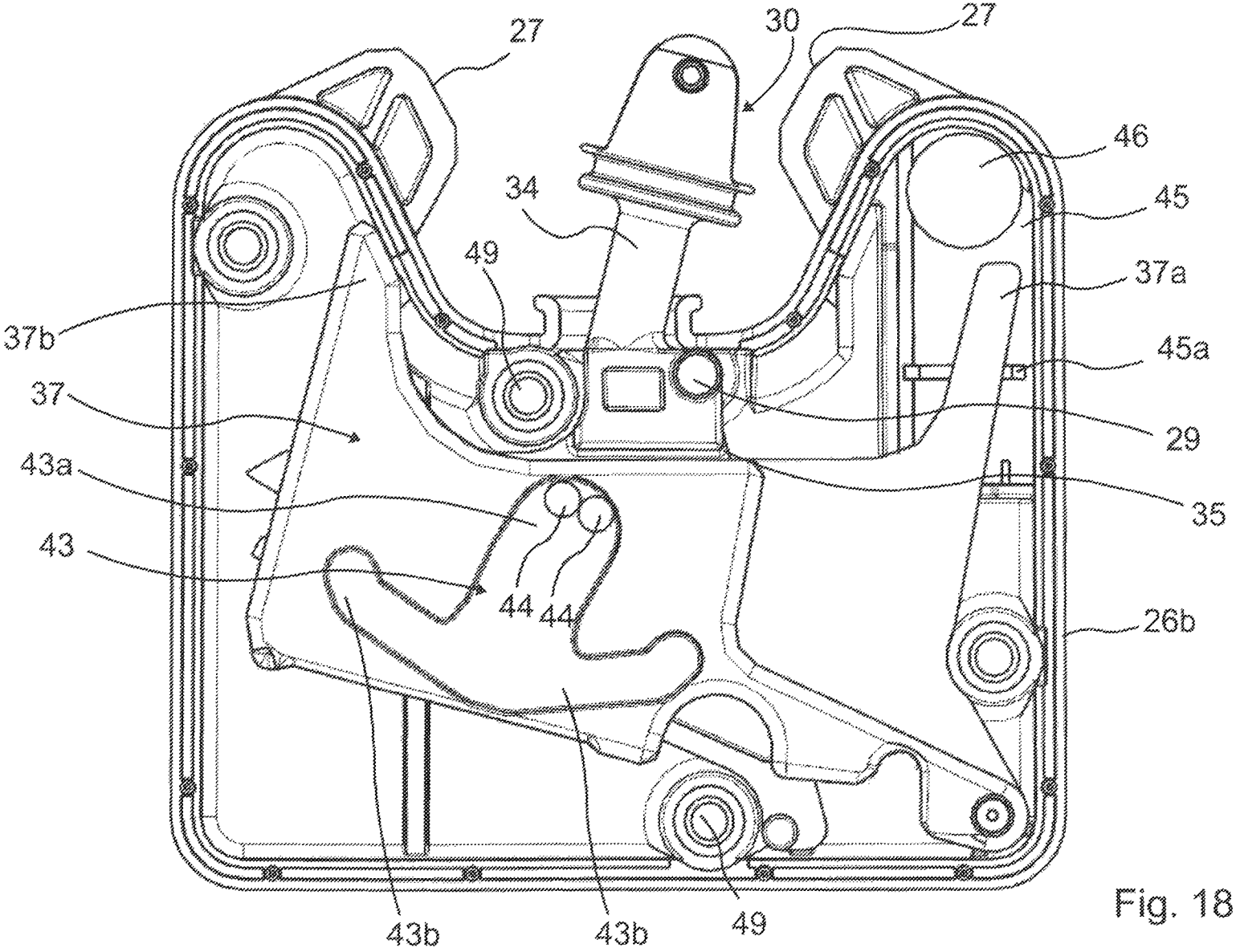
FIG. 18 a view similar to FIG. 15 with the first and second locking elements in their release positions.
Figure 19:
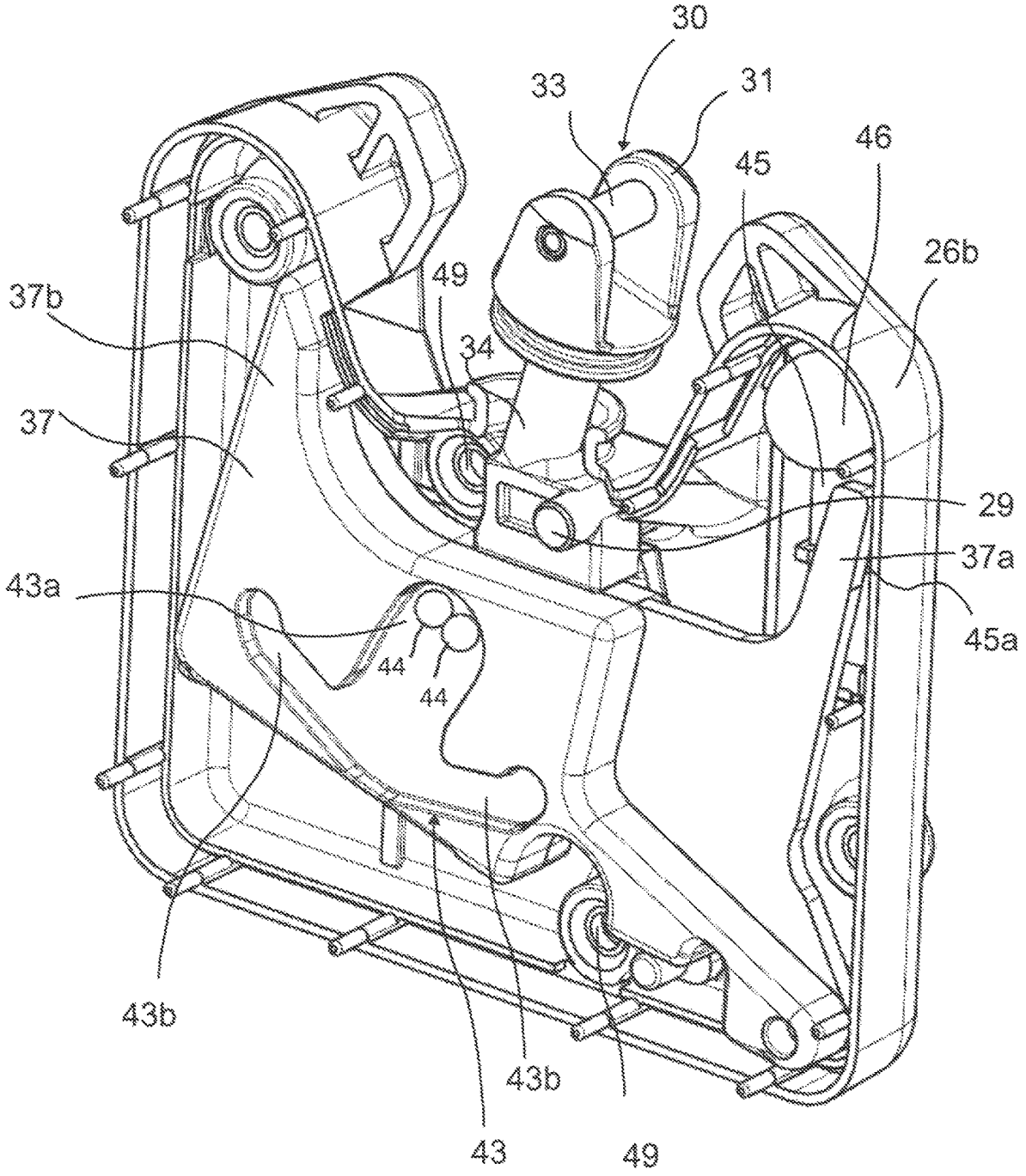
FIG. 19 a perspective view of the arrangement shown in FIG. 18.

The lock device further comprises a lower lock part 25 cooperating with the upper lock part 7, said lower lock part 25, as shown in FIG. 21, being fixed in the upper part of the inner side of the front wall of container 3. The lower lock part 25 comprises a lower lock part housing 26 which is composed of a front housing element 26*a* and a rear housing element 26*b*, as best illustrated in FIGS. 12 and 13. In the upper part of the lower lock part housing 26, there is a deepening 28 which is open at the top and is bounded laterally by insert chamfers 27, which slope towards each other in a V-shape. The insert chamfers 27 of the lower lock part housing 26 correspond to the insert chamfers 24 of the inner housing element 8*b* of the upper lock part housing 8, so that the upper lock part housing 8 is automatically aligned with the lower lock part housing 26 when the cover 5 of the container is closed, when the upper lock part 7 is inserted into the lower lock part 25 from above. The lower lock part 25 comprises a second locking element 30 projecting upwardly from the lower lock part housing 26 into the deepening 28, said second locking element being pivotably movable about a swivel axis 29 between a blocking position shown in FIGS. 14 to 17 and a release position shown in FIGS. 18 and 19, and engageable in the blocking position with a first locking element 11 by moving the latter from its unlocking position to its locking position in the closed condition of the cover 5 in order to block the cover 5. The second locking element 30 is formed in the present case by a substantially U-shaped holder 31, which receives in the upper section a pin 32 extending parallel to the swivel axis 10 of the first locking element 11, wherein a sleeve 33 is fitted to the pin 32. The holder 31 is connected via a web 34 to a swivel part 35 which is designed and pivotably accommodated in the lower lock part housing 26 in such a way that it positions the second locking element 30 in an upright position of the container 3 of the waste receiving device 2 in the blocking position, in which it can be engaged with a first locking element 11, and, when the container 3 is tilted forward to empty it, is transferred to the release position shown in FIGS. 18 and 19 in which it is disengaged from the first locking element in its locking position. The second locking element 30 and the swivel part 35 are made in one piece of plastic. Alternatively, they can also be joined together as individual components. The web 34, which connects the second locking element 30 with a swivel part 35, is surrounded by a flexible gaiter 36 in order to counteract contamination of the interior of the lower lock part housing 26. The pivoting movement of the swivel part 35 about the swivel axis 29 is brought about by a weight part 37 which is made of metal and is held rotatably about a swivel axis 38 on the front housing element 26*a* of the lower lock part housing 26. The swivel part 35 is engaged with this weight part 37 via a recess 39 which engages on a projection 40 projecting from the weight part 37. A guiding pin 41 of the swivel part 35, which is arranged opposite the recess 39 and protrudes towards the weight part 37, engages from the bottom into an indentation 42 formed at the lower side of the weight part 37 in the blocking position of the second locking element 30, from which indentation 42 it is guided out in the release position. The weight part 37 defines at its front side a rear part of a substantially T-shaped guide 43 with a substantially upright extending guide section 43*a* defining a circular section around the swivel axis 38 of the weight part 37 and two anchor-like upwardly bent guide sections 43*b* branching off from this at the lower end on both sides, said guide sections 43*b* extending substantially laterally. The associated front counterpart of guide 43 is formed on the rear side of the front housing element 26*a* of the lower lock part housing 26. Within the guide 43, two arresting means 44 in the form of balls are movably guided, said balls only releasing the pivoting movement of the weight part 37 and, thus, the second locking element 30 when they are positioned by gravity at the upper end of the substantially upright extending guide section 43*a*. This is only the case, when the container 3, starting from its upright position, is tilted straight forward or backward beyond its horizontal position. As soon as the tilting movement experiences a lateral component, the arresting means 44 also move under gravity into one of the guide sections 43*b* and block the pivoting movement of the weight part. In principle, it is possible to provide only one arresting means 44. However, two arresting means 44 are preferred, as they prevent each other from uncontrolled movements. A further guide 45 is formed at an upper edge area of the lower lock part housing 26. This guide 45, which accommodates a further arresting means 46 in the form of a ball, extends vertically, so that the arresting means 46 can be moved upwards and downwards within the guide 45 between an upper position and a lower position. In its lower position, which the arresting means 46 occupies by gravity in the upright position of the container 3, it engages a blocking shoulder 37*a* projecting upwards from the weight part 37, said blocking shoulder 37*a* preventing the weight part 37 and thus the second locking element 30 from pivoting into the release position of the second locking element 30. The blocking shoulder 37*a* of the weight part 37 ends below the upper position, so that the weight part 37, when the arresting means 46 reaches its upper position under the force of gravity when the container 3 is tilted forward beyond its horizontal position, can pivot about its swivel axis 38. Within the scope of this pivoting movement, it takes the swivel part 35 with it so that the second locking element 30 pivots about its associated swivel axis 29 to the release position. During this pivoting movement of the swivel part 35, its guiding pin 41 is transferred from the first indentation 42 to the second indentation 43 of the weight part 37. The guide surface of the guide 45 is provided at the rear between the lower position and the upper position of the arresting means 46 with an obstacle 45*a*, here in the form of a rib projecting forward, which prevents or at least makes it more difficult for the first arresting means 46 to move from the lower position to the upper position when the container is tilted backwards from the upright position. The weight part 37 further defines an upwardly protruding stop 37*b* which limits the pivoting movement and which strikes against the inside of the lower lock part housing 26. The housing elements 26*a* and 26*b* of the lower lock part housing 26 are screwed together using fixing screws 47. For fastening to the container 3, the lower lock part housing 26 is pressed on the front side against a gasket 48 adapted to the shape of the corresponding container wall to which the lower lock part housing 26 is to be fastened and then screwed together with the container 3 using further fixing screws 47. For this purpose, the housing elements 26*a* and 26*b* of the lower lock part housing 26 are provided with corresponding bushing receptacles 49. These bushing receptacles 49 are aligned with corresponding (not shown) holes provided on container 3. Bushings 51 connected to each other from the outside via a bushing part 50 are then pushed through the holes and the bushing receptacles 49, into which bushings 50 the fixing screws 47 are then screwed from behind. In this way, the lower lock part 25 can be securely fastened to the container 3 in such a way that it is inaccessible from the outside, as shown in FIG. 22.

FIGS. 20 to 22 show the lock device 1 in the condition in which it is attached to a waste receiving device 2 to lock the cover 5 to the container 3. This is to prevent unauthorized third parties from filling container 3 or removing things from container 3. The outer housing element 8*a* of the lower lock 1*s* part housing 8 is placed on the container 5 from above and screwed to the inner housing element 8*b* of the upper lock part housing 8, which is placed on the cover 5 from below. The lower lock part housing 26 is attached from the inside to the front wall of container 3 in the manner described above in such a way that the first locking element 11 can be engaged with a second locking element 30 when the cover 5 is closed. The V-shaped insert chamfers 24 and 27 provided on the upper lock part housing 8 and on the lower lock part housing 26 ensure that the upper lock part housing 8 and the lower lock part housing 26 are properly aligned and engaged with each other when the cover 5 is closed. As soon as the first locking element 11 is positioned from above on the sleeve 33 of the second locking element 30 surrounding the pin 32, the first locking element 11, due to its contact surface 21 provided at the lower end, is moved by the exerted pressure to the left into its unlocking position so that it can pass the pin 32 or the sleeve 33. Locking element 11 is moved back into its locking position by the spring force of the spring element 18 so that its engagement opening 20 engages on the pin 32 or the sleeve 33 of the second locking element 30. In order to be able to lift the cover 5 from this position back of the container 3, the locking mechanism 9 must be actuated by the key 14 to move the first locking element 11 into its unlocking position.

When, in a blocked state of the cover 5, the container 3 is tilted for emptying to from its upright position forward beyond the horizontal position, the arresting means 46 automatically moves from its lower position to its upper position. The same applies to the arresting means 44 guided in a the substantially T-shaped guide 43, which move from the lower position along the substantially upright extending guide section 43*a* to a position at the upper end of the substantially upright extending guide section 43*a*. In this state, the pivoting movement of the weight part 37, which is initiated by gravity, is released so that the second locking element 30 is transferred from its blocking position to the release position via the weight part 37. Correspondingly, the second locking element 30 comes out of engagement with a first locking element 11 positioned in its locking position so that cover 5 opens automatically.

If the container 3 is tilted by an external force having a lateral component, the arresting means 44 move within the substantially T-shaped guide 43 along the guide sections 43*b* of the guide extending substantially laterally whereby a pivoting movement of the weight part 37, which is also initiated here by gravity, is prevented. Accordingly, the second locking element 30 remains in engagement with a first locking element 11 positioned in its locking position, so that cover 5 does not open. Should, in the course of such a laterally tilting of the container 3, the spring element 18, which holds the first locking element 11 in its locking position, be overstressed and collapse, whereby it would be basically be possible to move the first locking element 11 into its unlocking position, this transfer to the unlocking position is prevented by the arresting means 22 guided in the guide 23 provided on the inner housing element 8*b* of the upper lock part housing 8, which moves to the left from the position shown in FIG. 8 to the position shown in FIG. 11, where it blocks any pivoting movement of the first locking element 11.

When the container 3 is tilted backwards from the upright position, the arresting means 46 guided in the guide 45 of the lower lock part 25 will move from the lower position towards the upper position. In doing so, it strikes against the obstacle 45*a* formed on the rear guide surface of the guide 45 and is correspondingly prevented from reaching the upper position, in which it releases the movement of the weight part 37 and the second locking element 30 into the release position. Accordingly, cover 5 will not open here either.

It should be clear that the embodiment described above is only an example and in no way restrictive. Rather, modifications and alterations are possible without leaving the scope of protection of the present application as defined in the enclosed claims.

| Reference character list | |
|---|---|
| 1 | Lock device |
| 2 | Waste receiving device |
| 3 | Container |
| 4 | Container lip |
| 5 | Cover |
| 6 | Cover swivel axis |
| 7 | Upper lock part |
| 8 | Upper lock part housing |
| 8a | Outer housing element |
| 8b | Inner housing element |
| 9 | Locking mechanism |
| 10 | Swivel axis |
| 11 | First locking element |
| 11a | Actuating section |
| 11b | Supporting section |
| 11c | Blocking section |
| 11d | Emergency unlocking section |
| 12 | Screw-on mandrel |
| 13 | Mandrel receptacle |
| 14 | Key |
| 15 | Bar |
| 16 | Swivel axis |
| 17 | Arrow |
| 18 | Spring element |
| 19 | Supporting wall |
| 20 | Engagement opening |
| 21 | Contact surface |
| 22 | Arresting means |
| 23 | Guide |
| 24 | Insert chamfer |
| 25 | Lower lock part |
| 26 | Lower lock part housing |
| 26a | Front housing element |
| 26b | Rear housing element |
| 27 | Insert chamfer |
| 28 | Deepening |
| 29 | Swivel axis |
| 30 | Second locking element |
| 31 | Holder |
| 32 | Pin |
| 33 | Sleeve |
| 34 | Web |
| 35 | Swivel part |
| 36 | Gaiter |
| 37 | Weight part |
| 37a | Blocking shoulder |
| 37b | Stop |
| 38 | Swivel axis |
| 39 | Recess |
| 40 | Projection |
| 41 | Guiding pin |
| 42 | Indentation |
| 43 | Guide |
| 43a | Guide section |
| 43b | Guide section |
| 44 | Arresting means |
| 45 | Guide |
| 45a | Obstacle |
| 46 | Arresting means |
| 47 | Fixing screw |
| 48 | Gasket |
| 49 | Bushing receptacle |
| 50 | Bushing part |
| 51 | Bushing |

The invention claimed is:

1. A lock device (1) for a waste receiving device (2) comprised of a container (3) that defines on an upper side a container opening enclosed by a container lip (4), and a cover (5) that is held on the container (3), said cover (5)

being pivotably movable about a cover swivel axis (6) between a closed position that closes the container opening and an open position that uncovers the container opening, said lock device (1) comprising:

an upper lock part (7) to be fastened on the cover, having each of an upper lock part housing (8), a locking mechanism (9) received in the upper lock part housing (8), and a first locking element (11) projecting downwards from the upper lock part housing (8) and being pivotable about a swivel axis (10) between a locking position and an unlocking position by actuating the locking mechanism (9); and a lower lock part (25) to be fastened on the container, having each of a lower lock part housing (26), a second locking element (30) projecting upwards from the lower lock part housing (26) and being pivotable about a swivel axis (29) between a blocking position and a release position, wherein said second locking element (30) cooperates in the blocking position with the first locking element (11) being in the locking position in such a way that the cover (5) is locked, a weight part (37) operatively connected to the second locking element (30), said weight part (37) being pivotably received in the lower lock part housing (26) to position the second locking element (30) in the blocking position when the container (3) is in the upright position, and is automatically transferred into the release position, in which the second locking element (30) is brought out of engagement with the first locking element (11) positioned in the locking position, when the container (3) is tilted forward for emptying, and a first arresting means (46) being movably received in the lower lock part housing (26), said first arresting means (46) arresting the second locking element (30) in the blocking position when the container (3) is in the upright position, wherein a second arresting means (44) is received movably in the lower lock part housing (26) and is arranged and formed to arrest the second locking element (30) in the blocking position when the container (3) is tilted laterally from the upright position, said second arresting means (44) comprising a ball that is movably guided within the lower lock part housing (26) in a T-shaped guide (43) that includes a substantially upright extending guide section (43*a*) and two guide sections (43*b*) branching off to both sides thereof at a lower end thereof and extending substantially laterally, the ball releasing the pivoting movement of the weight part (37) only when positioned at the upper end of the substantially upright extending guide section (43*a*).

2. The lock device (1) according to claim 1, wherein the upper lock part housing (8) and the lower lock part housing (26) define insert chamfers (24, 27) which engage each other when the cover (5) is moved in the closed position and align the first locking element (11) and the second locking element (30) with each other.

3. The lock device (1) according to claim 2, wherein the first arresting means (46) is formed as a ball which is movable upwards and downwards guided in a guide (45) within the lower lock part housing (27) between an upper position and a lower position, and which blocks the pivoting movement of the weight part (37) in the lower position and releases the weight part (37) in the upper position.

4. The lock device (1) according to claim 1, wherein the upper lock part housing (8) is composed of an outer housing element (8*a*) projecting outwardly from the cover (5) and an inner housing element (8*b*) projecting inwardly from the cover (5), the locking mechanism (9) being arranged on the outer housing element (8*a*) and the first locking element (11) together with the swivel axis (10) being arranged on the inner housing element (8*b*).

5. The lock device (1) according to claim 4, wherein a bar (15), being pivotable about a swivel axis by actuation of the locking mechanism (9), is provided in the outer housing element (8*a*), said bar (15) cooperating with an actuating section (11*a*) of the first locking element (11) arranged on the inner housing element (8*b*), said actuating section (11*a*) projecting upwards into the outer housing element (8*a*).

6. The lock device (1) according to claim 5, wherein the first arresting means (46) is formed as a ball which is movable upwards and downwards guided in a guide (45) within the lower lock part housing (27) between an upper position and a lower position, and which blocks the pivoting movement of the weight part (37) in the lower position and releases the weight part (37) in the upper position.

7. The lock device (1) according to claim 4, wherein the first arresting means (46) is formed as a ball which is movable upwards and downwards guided in a guide (45) within the lower lock part housing (27) between an upper position and a lower position, and which blocks the pivoting movement of the weight part (37) in the lower position and releases the weight part (37) in the upper position.

8. The lock device (1) according to claim 1, wherein the first arresting means (46) is formed as a ball which is movable upwards and downwards guided in a guide (45) within the lower lock part housing (27) between an upper position and a lower position, and which blocks the pivoting movement of the weight part (37) in the lower position and releases the weight part (37) in the upper position.

9. The lock device (1) according to claim 8, wherein the guide surface of the guide (45) of the first arresting means (46) is provided at a rear side with an obstacle (45*a*) which is formed to make more difficult a movement of the first arresting means (46) from the lower position to the upper position when the container (3) is tilted backwards from the upright position to a lying position.

10. The lock device (1) according to claim 8, wherein the first arresting means (46) is formed as a ball which is movable upwards and downwards guided in a guide (45) within the lower lock part housing (27) between an upper position and a lower position, and which blocks the pivoting movement of the weight part (37) in the lower position and releases the weight part (37) in the upper position.

11. The lock device (1) according to claim 1, wherein the substantially laterally extending guide sections (43*b*) bend upwards.

12. The lock device (1) according to claim 1, wherein said second arresting means (44) further comprises a second ball guided in the T-shaped guide (45).

13. The lock device (1) according to claim 1, wherein the first locking element (11) is pretensioned via a spring element (18) in a direction of the locking position in such a way that a transfer of the first locking element (11) from the locking position into the unlocking position is effected by actuating the locking mechanism (9) against a spring force of the spring element (18).

14. The lock device (1) according to claim 13, wherein a third arresting means (22) is movably received in the inner housing element (8*b*) of the upper lock part housing (8), said third arresting means (22) being configured to arrest the first locking element (11) in the locking position when the container (3) is tilted laterally from the upright position into a lying position.

15. The lock device (1) according to claim 14, wherein the third arresting means (22) comprises a ball which is movably guided inside the inner housing element (8*b*) of the upper lock part housing (8), in a laterally extending guide (23) between a lower position and an upper position, and which arrests, when in the upper position, the first locking element (11) in the locking position.

16. A waste receiving device (2) comprising a container (3) having on an upper side thereof a container opening enclosed by a container lip (4), a cover (5) held on the container (3), said cover (5) being movable between a closed position covering the container opening and an open position uncovering the container opening pivoting about a cover swivel axis (6) which extends along a container rear side, and the lock device (1) according to claim 1.

* * * * *